US005101232A

United States Patent [19]

Evans et al.

[11] Patent Number: 5,101,232

[45] Date of Patent: Mar. 31, 1992

[54] PHASE CONTROL OF A SEAMED PHOTORECEPTOR BELT

[75] Inventors: Charles F. Evans, Rochester; Stuart A. Schweid, Henrietta; James B. O'Leary, Rochester, all of N.Y.

[73] Assignee: Xerox Corporation, Stamford, Conn.

[21] Appl. No.: 747,041

[22] Filed: Aug. 19, 1991

[51] Int. Cl.[5] ..... G03G 21/00

[52] U.S. Cl. ..... 355/208; 355/212; 355/317

[58] Field of Search ..... 355/203, 204, 208, 212, 355/317, 200, 210, 211

[56] References Cited

U.S. PATENT DOCUMENTS

| | | | |
|---|---|---|---|
| 3,917,400 | 11/1975 | Rodek et al. | 355/50 |
| 4,416,534 | 11/1983 | Kluger | 355/208 X |
| 4,588,284 | 5/1986 | Federico et al. | 355/200 |
| 4,860,054 | 8/1989 | Higuchi | 355/211 X |
| 4,980,723 | 12/1990 | Buddendeck et al. | 355/218 |

FOREIGN PATENT DOCUMENTS

| | | | |
|---|---|---|---|
| 0124570 | 6/1987 | Japan | 355/212 |

*Primary Examiner*—A. T. Grimley
*Assistant Examiner*—William J. Royer
*Attorney, Agent, or Firm*—Duane C. Basch

[57] ABSTRACT

An apparatus and associated method for controlling the velocity of the photoreceptor within a reprographic machine having a seamed, web type photoreceptor, for producing a plurality of images thereon. The images being separated by unexposed interdocument regions on the photoreceptor. The reprographic machine further including a registration apparatus for registering copy substrates with developed latent images. The process of assuring that the seamed region of the photoreceptor lies within an interdocument region begins by first sensing an actual phase relationship between the photoreceptor seam and the activity of the registration apparatus and then calculating a phase error value by comparing the actual phase relationship to a desired phase relationship. Next, the system determines an adjustment photoreceptor velocity as a function of the phase error. Subsequently, the photoreceptor is moved at a fixed velocity during exposure of the images. Changing the calculated reference and hence photoreceptor velocity is restricted to the interdocument zone, so that there are no velocity changes except when the interdocument zone is passing through the imaging station. This ensures that the registration requirements and image quality specifications are simultaneously accomplished.

11 Claims, 8 Drawing Sheets

FIG. 6A
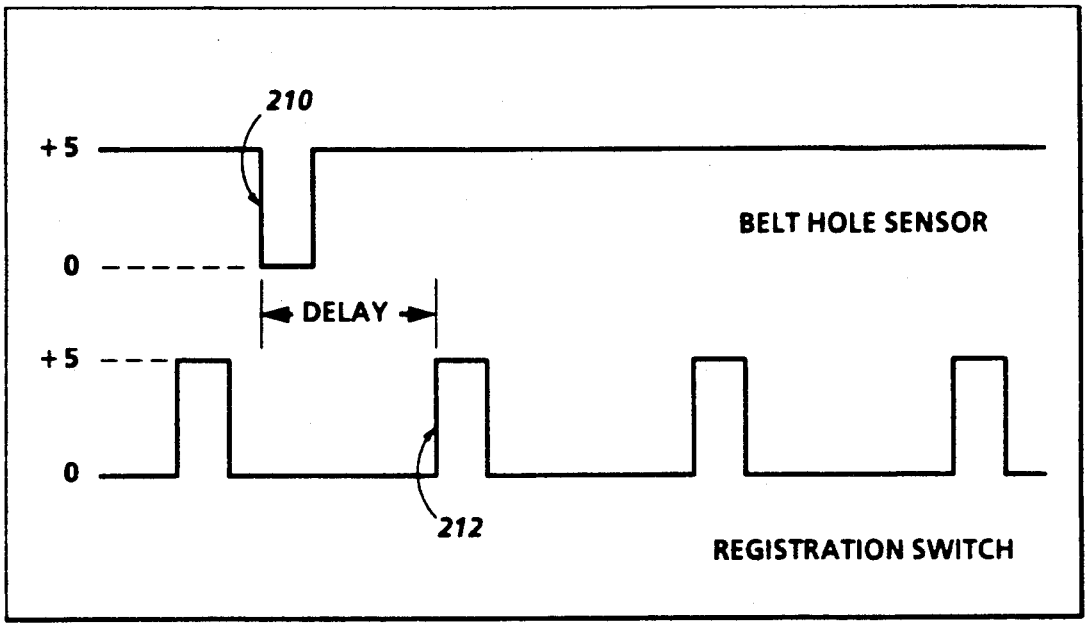
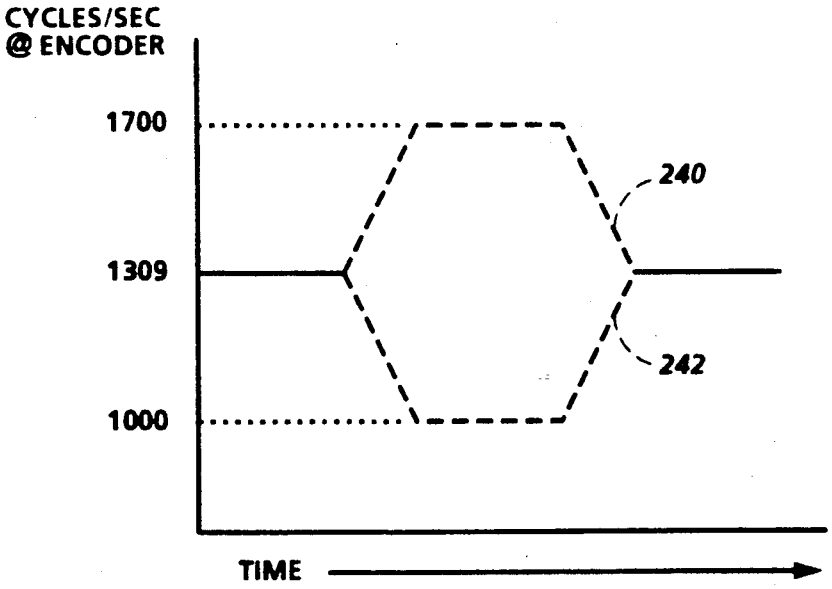
FIG. 6B

PHASE CONTROL OF A SEAMED PHOTORECEPTOR BELT

BACKGROUND AND SUMMARY OF THE INVENTION

This invention relates generally to an electrophotographic printing machine having a seamed, web-type photoreceptor suitable for the exposure of one or more document images on the surface thereof, and more particularly to a method and apparatus for controlling the location of the photoreceptor seam in relation to the document images.

The features of the present invention may be used in the printing arts and, more particularly in electrophotographic printing. In the process of electrophotographic printing, a photoconductive surface is charged to a substantially uniform potential. The photoconductive surface is then image-wise exposed to record an electrostatic latent image corresponding to the informational areas of an original document being reproduced. Thereafter, a developer material is transported into contact with the electrostatic latent image. Toner particles are attracted from the carrier granules of the developer material onto the latent image. The resultant toner powder image is then transferred from the photoconductive surface to a copy sheet and permanently affixed thereto. The foregoing description generally describes a typical single color electrophotographic copying machine.

A typical machine of this type would be the Xerox ® 1090 ® copier. Such a machine employs a mechanical rephaser to control the position of the photoreceptor seam with respect to the exposed or latent image areas of the photoreceptor. Generally, the rephaser is a gear box having two speeds for control of the speed at which the copy sheet is advanced as it is brought into registration with the latent image on the photoreceptor. Generally, the copy sheet transport system is used to trigger the exposure mechanism which creates the latent image on the photoreceptor. Periodically, once per photoreceptor revolution, the location of the photoreceptor seam is sensed and the rephaser is energized or deenergized for a period of time necessary to correct for the positioning of the advancing copy sheet, and in turn, the position of the latent image on the photoreceptor web. More specifically, the photoreceptor belt is moved at a predefined velocity, and the rate of travel of the advancing copy sheet is controlled so as to regulate the exposure and transfer operations in accordance with the position of the advancing sheet. Minor variations in the speed of the main drive motor, due to variations in the power line voltage, result in a variation of the position of latent images on the photoreceptor. Unfortunately, these variations are cumulative in nature and must be corrected to assure that the latent images are exposed at generally the same position on the photoreceptor each time. If not corrected, the cumulative variation would eventually cause one of the exposed latent image areas to occur over the photoreceptor seam, subsequently resulting in an unacceptable copy.

Such a system works well for typical single color systems, such as the Xerox ® 1090 ® copier, but lacks the reliability for accurate velocity and position control of the photoreceptor required in multicolor development systems. Also, after significant variations have occurred in the photoreceptor velocity, resulting in the mis-positioning of the photoreceptor seam, the system may require a "dead" or nonoperative cycle, during which the copier once again repositions the seam to the interdocument region. Furthermore, the rephaser mechanism is a relatively expensive apparatus which provides the mechanical drive linkage between the photoreceptor drive and the copy sheet transport system. Hence, a more flexible and less costly drive system would be desirable.

Another technique used to control two moving members in a reprographic system is illustrated by U.S. Pat. No. 3,917,400 to Rodek et al. (Issued Nov. 4, 1975) which discloses a method and apparatus for maintaining a predetermined phase relationship between signals representing the velocity of a first variable velocity movable member and the velocity of a second constant velocity movable member. A first sensor emits a pulse signal whenever one of a plurality of registration marks on the variable velocity movable member passes the sensor, and similarly, a second sensor emits a pulse whenever one of a plurality of registration marks on the constant velocity movable member passes the second sensor. A phase relationship between the two movable members is determined by measuring the phase relationship between the occurrence of the pulse signal of the first sensor and the pulse signal of the second sensor. A control signal, related to the phase relationship, is generated and is utilized to vary the velocity of the variable velocity movable member so that a predetermined phase relationship (i.e. zero phase difference) is established for the two signals. Furthermore, a portion of the control signal generated to reduce the signal to zero is used to reduce a subsequent phase difference calculation to zero, thereby compensating for the fact that the velocity of the variable velocity movable member is still being adjusted as the subsequent difference calculation is being made.

A related method of positioning an electrostatic latent image on a photoconductive belt is described in U.S. Pat. No. 4,980,723 to Buddendeck et al. (Issued Dec. 25, 1990), and is hereby incorporated by reference for the teachings therein. The reference discloses a system capable of adjusting the number of latent image regions which are exposed on the photoconductive belt. More specifically, a portion of the inter-image zone is utilized to accomodate the shifting of the latent image positions on the belt. Furthermore, a control system for automatically altering the pitch, or number of latent images on a photoconductive belt, during operation is taught by U.S. Pat. No. 4,588,284 to Federico et al. (Issued May 13, 1986), where a memory flag is monitored to control the selection of a different number of pitches. The flag is also used to control the clock signals used for the timed actuation of events with respect to the selected pitch. The relevant portions of U.S. Pat. No. 4,588,284 to Federico et al. are hereby incorporated by reference.

The present invention seeks to overcome the limitations of the mechanical rephaser type control system, by mechanically decoupling the photoreceptor drive from the copy sheet registration and transport drives. Moreover, the present system has the added advantage of being able to control the phase relationship between two independently variable elements, the photoreceptor speed and the advancing copy sheets, in a reliable manner.

In accordance with one aspect of the present invention, there is provided a method for controlling the velocity of the photoreceptor within a reprographic machine of the type having a seamed, web type photoreceptor, for producing a plurality of developed images thereon, said developed images being separated by unexposed interdocument regions or zones on the photoreceptor, and means for registering copy substrates with the developed images. The method of assuring that the seamed region of the photoreceptor lies within an interdocument region begins by first sensing an actual phase relationship between the photoreceptor seam and the activity of the sheet registration apparatus. The method then calculates a phase error value by comparing the actual phase relationship between the photoreceptor seam and the registration apparatus to a desired phase relationship. As the next step, the system determines a new photoreceptor speed as a function of the phase error. Finally, the photoreceptor is accelerated or decelerated to a new constant velocity during interdocument gaps. The new constant velocity remains in effect during the subsequent exposure of the latent images. During operation of the reprographic machine, the above steps are executed once per revolution of the photoreceptor.

Pursuant to another aspect of the present invention, there is provided an electrophotographic printing machine of the type having a seamed, web type photoreceptor, for producing a plurality of developed images thereon, where the developed images are separated by unexposed interdocument zones on the photoreceptor. The machine also has an independently driven copy substrate registering apparatus for registering copy sheets in synchronization with the developed images on the photoreceptor. Included in the machine are phase measurement means for quantizing the phase relationship between the photoreceptor seam and an edge of the advancing copy sheets, and phase error calculating means for determining the variation in the phase relationship with respect to a desired phase relationship. Also included is a controller for adjusting the photoreceptor speed as a function of the phase error, during the interdocument zones, and then driving the photoreceptor at a constant velocity during image exposure.

BRIEF DESCRIPTION OF THE DRAWINGS

FIG. 6A is an illustration of the timing signals used to determine the phase error of the photoreceptor;

FIG. 6B is an illustration of the velocity profile of the photoreceptor to correct for phase error.

The present invention will be described in connection with a preferred embodiment, however, it will be understood that there is no intent to limit the invention to that embodiment. On the contrary, the intent is to cover all alternatives, modifications, and equivalents as may be included within the spirit and scope of the invention as defined by the appended claims.

BRIEF DESCRIPTION OF THE APPENDICES

The following description makes reference to a collection of Appendices (A-D) which are included with this specification, the contents of which may be briefly characterized as follows:

Appendix A is a listing of the microcontroller assembly code for the main module of the servomotor control software, which serves as a background loop for many of the other modules and calls procedures listed in Appendices B, C, and D;

Appendix B is an assembly code listing of the the module associated with maintaining the positional relationship between the latent image and the belt seam, which utilizes positional information gathered during microcontroller interrupts to determine the position or phase error;

Appendix C is an assembly code listing for the motor control software; and

Appendix D is a listing of the assembly code for the interrupts which are processed by the microcontroller.

DESCRIPTION OF THE PREFERRED EMBODIMENT

Figure 1:
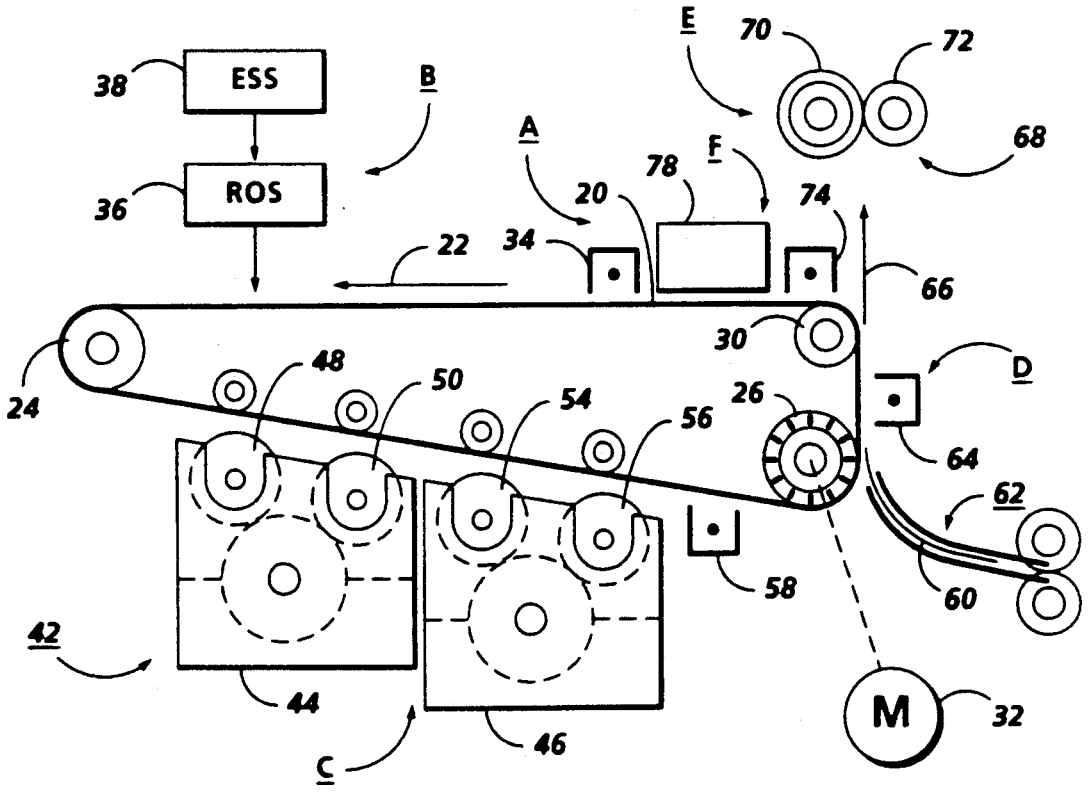
FIG. 1 is a schematic elevational view of an illustrative electrophotographic printing machine having the photoreceptor drive unit incorporating the present invention.

For a general understanding of the illustrative electrophotographic printing machine incorporating the features of the present invention, reference is made to the drawings. In the drawings, like reference numerals have been used throughout to designate identical elements. FIG. 1 schematically depicts the various components of an electrophotographic printing machine incorporating the photoreceptor drive controller of the present invention. Although the photoreceptor drive control of the present invention is particularly well adapted for use in the illustrative printing machine, it is equally well suited for use in a wide variety of printing machines.

Referring now to FIG. 1, the two color electrophotographic printing machine employs a belt 20, i.e. a charge retentive member, having a photoconductive surface deposited on a conductive substrate. In one embodiment, the photoconductive surface is made from a trigonal selenium alloy with the conductive substrate being made preferably from an electrically grounded aluminum alloy. Belt 20 moves in the direction of arrow 22 to sequentially advance successive portions through the various processing stations disposed about the path of movement. Belt 20 is entrained about tensioning roller 24, encoded drive roller 26, and stripping roller 30. Motor 32 rotates roller 26 to advance belt 20 in the direction of arrow 22. Roller 26, coupled to motor 32 by suitable means such as a belt drive, is further coupled to an encoder (not shown) so that the velocity of the roller may be monitored.

Initially, successive portions of belt 20 pass through charging station A, where a corona discharge device, such as a scorotron, corotron or dicorotron indicated generally by the reference numeral 34, charges the belt 20 to a selectively high uniform positive or negative potential. Preferably, the the photoreceptor is charged to a negative potential. Any suitable control, well known in the art, may be employed for controlling corona discharge device 34.

Next, the charged portions of the photoconductive surface are advanced through exposure station B. At exposure station B, the uniformly charged photoconductive surface or charge retentive surface is exposed to a laser based input and/or output scanning device 36 which causes the charge retentive surface to be discharged in accordance with the output from the scanning device. Preferably the scanning device is a three level laser Raster Output Scanner (ROS). An electronic sub system (ESS) 38 provides the control electronics which prepare the image data flow between the data source (not shown) and ROS 36. Alternatively, the ROS and ESS may be replaced by a conventional light/lens exposure device. The photoconductive surface, which is initially charged to a high charge potential, is discharged image wise in the background (white) image areas and to near zero or ground potential in the highlight color (i.e. color other than black) parts of the image.

At development station C, a magnetic brush development system, indicated generally by the reference numeral 42 advances developer materials into contact with the electrostatic latent images. The development system 42 comprises first and second developer units 44 and 46, respectively. Preferably, each magnetic brush developer unit includes a pair of magnetic brush developer rollers mounted in a housing. Thus, developer unit 44 contains a pair of rollers 48, 50, and developer unit 46 contains a pair of magnetic brush rollers 54, 56. Each pair of rollers advances its respective developer material into contact with the latent image. Appropriate developer biasing is accomplished via power supplies (not shown) electrically connected to the respective developer units 44 and 46.

Color discrimination in the development of the electrostatic latent image is achieved by moving the latent image recorded on the photoconductive surface past two developer units 44 and 46 in a single pass with the magnetic brush rolls 48, 50, 54 and 56 electrically biased to voltages which are offset from the background voltage, the direction of offset depending on the polarity of toner in the developer housing. First, developer unit 44 develops the discharged areas of the latent image with colored developer material having triboelectric properties such that the colored toner is driven to the discharged image areas of the latent image by the electrostatic field between the photoconductive surface and the electrically biased developer rolls. Conversely, second developer unit 46, develops the highly charged image areas of the latent image. This developer unit contains black developer material having a triboelectric charge such that the black toner is urged towards highly charged areas of the latent image by the electrostatic field existing between the photoconductive surface and the electrically biased developer rolls in the second developer unit.

Because the composite image developed on the photoreceptor consists of both positive and negative toner, a negative pre-transfer corona discharge member 58 is provided to condition the toner for effective transfer to a sheet using a positive corona discharge A sheet of support material, 60, is moved into contact with the toner image at transfer station D. The sheet of support material is advanced to transfer station D by sheet transfer apparatus 62. Preferably, the sheet transfer apparatus receives sheet 60 from a sheet feeding apparatus (not shown) which includes a feed roll contacting the uppermost sheet of a stack of copy sheets (not shown). The feed rolls rotate so as to advance the uppermost sheet from the stack into the sheet transfer apparatus which directs the advancing sheet of support material into contact with the photoconductive surface of belt 20 in a timed sequence so that the composite toner powder image contacts the advancing sheet of support material at transfer station D.

Transfer station D includes a corona generating device 64 which sprays ions of a suitable polarity onto the backside of sheet 60. This simultaneously attracts the black and non-black portions of the toner powder image from belt 20 to sheet 60. After transfer, the sheet continues to move, in the direction of arrow 66, onto a conveyor (not shown) which advances the sheet to fusing station E.

Fusing station E includes a fuser assembly, indicated generally by the reference numeral 68, which permanently affixes the transferred powder image to sheet 60. Preferably, fuser assembly 68 comprises a heated fuser roller 70 and a pressure roller 72. Sheet 60 passes between fuser roller 70 and pressure roller 72 with the toner powder image contacting fuser roller 70. In this manner, the toner powder image is permanently affixed to sheet 60. After fusing, a chute (not shown) guides advancing sheet 60 to a catch tray (not shown) for subsequent removal from the printing machine.

After the sheet of support material is separated from the photoconductive surface of belt 20, the residual toner particles carried by the non-image areas of the photoconductive surface are charged to a suitable polarity and level by preclean charging device 74 to enable their removal. These particles are removed at cleaning station F where a vacuum assisted, electrostatic brush cleaner unit 78 is disposed. In the cleaner are two fur brush rolls that rotate at relatively high speeds creating mechanical forces that sweep the residual toner particles into an air stream provided by a vacuum source (not shown), then into a cyclone separator, and finally into a waste bottle. In addition, the brushes are triboelectrically charged to a very high negative potential which enhances the attraction of the residual toner particles to the brushes and increases the cleaning performance. Subsequent to cleaning, a discharge lamp (not shown) floods the photoconductive surface with light to dissipate any residual electrostatic charge remaining prior to the charging thereof for a successive imaging cycle.

Figure 2:
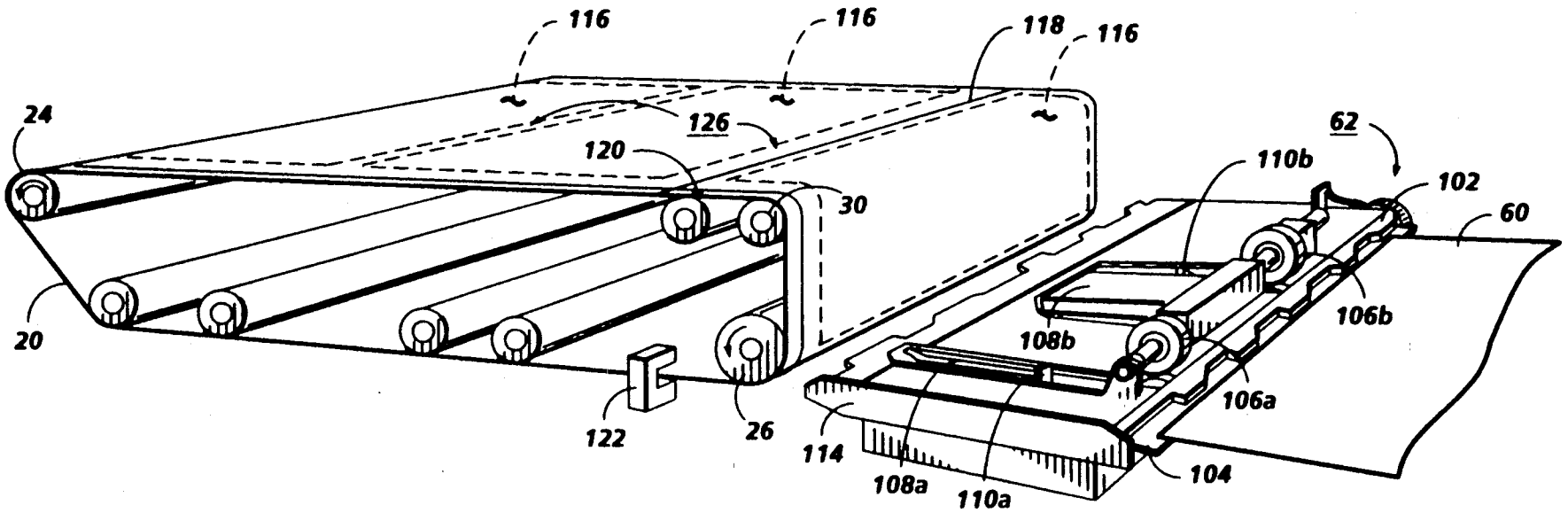
FIG. 2 is a perspective view of the photoreceptor and sheet registration apparatus of the present invention illustrating the locations and relationships of the active sensor elements of the present invention.

Referring now to FIG. 2, which further details the active mechanical and electrical components of the photoreceptor and sheet transfer apparatus, sheet 60 is shown entering the input side of sheet transfer apparatus 62. As sheet 60 enters transfer apparatus 62 it is initially maintained between upper and lower guides 102 and 104 respectively. Advancing into the chute formed between guides 102 and 104, the sheet is engaged by a feed nip which is formed by idler rolls 106*a*, *b* in contact with transport belts 108*a*, *b*, respectively. Once engaged by the feed nip, the sheet is advanced further into the chute where it contacts fingers 110*a*, *b* of the registration switch (not shown), thereby producing an electrical signal ("registration fingers") indicating the position of the lead edge of the copy sheet.

At this time, copy sheet 60 is also forced against side registration edge 114 to enable the accurate registration of the sheet in a direction normal to the process direction. The sheet is forced against the registration edge by rotational motion of frictional ball element (not shown), as is commonly used to register sheets in paper transport systems.

Having been side registered, the sheet is subsequently advanced towards photoreceptor belt 20, where it will meet in synchronization with developed latent image area 116 thereon. To avoid having seam 118 of belt 20 within one of the latent image areas 116, the position, or velocity, of the belt must be carefully controlled. To accomplish such a rigorous positioning requirement, timing or belt hole 120, having been cut into belt 20 at a predetermined displacement from seam 118, is carefully monitored to determine the position of the seam. Alternatively, the location of the photoreceptor seam may be indicated with a notch, a raised bump, or other readable mark applied to the surface of photoreceptor 20. Belt hole sensor 122, preferably an optoelectronic sensor, detects the presence of belt hole 120 once per revolution of the belt. As belt 20 rotates, the position of seam 118 is maintained within the gap or interdocument zone (IDZ) 126 that exists between the latent electrostatic images thereon, by carefully controlling the velocity, and position of the belt during each revolution.

Figure 3:
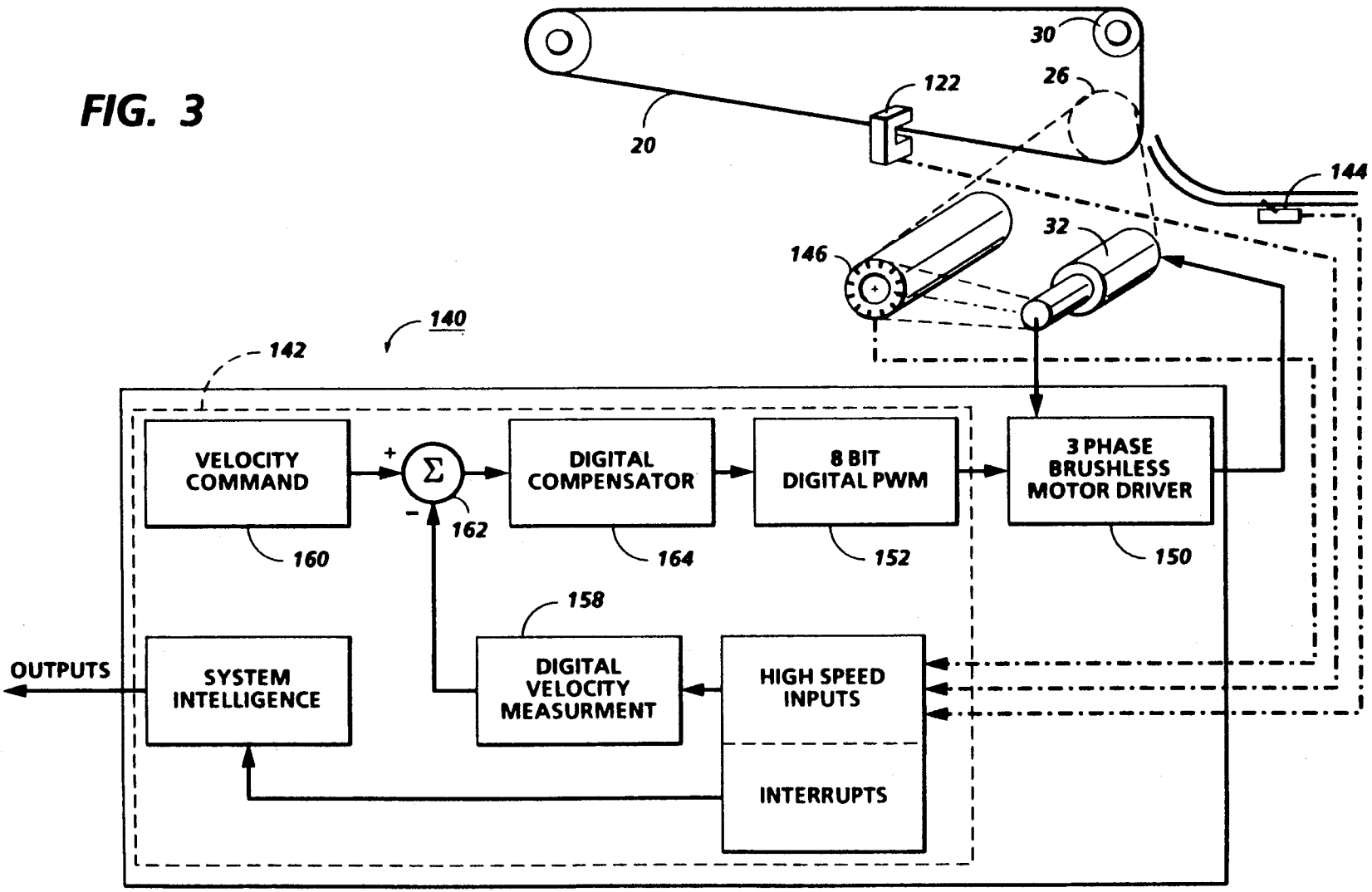
FIG. 3 is a schematic illustration of the photoreceptor drive unit incorporating the elements of the present invention.
Figure 4:
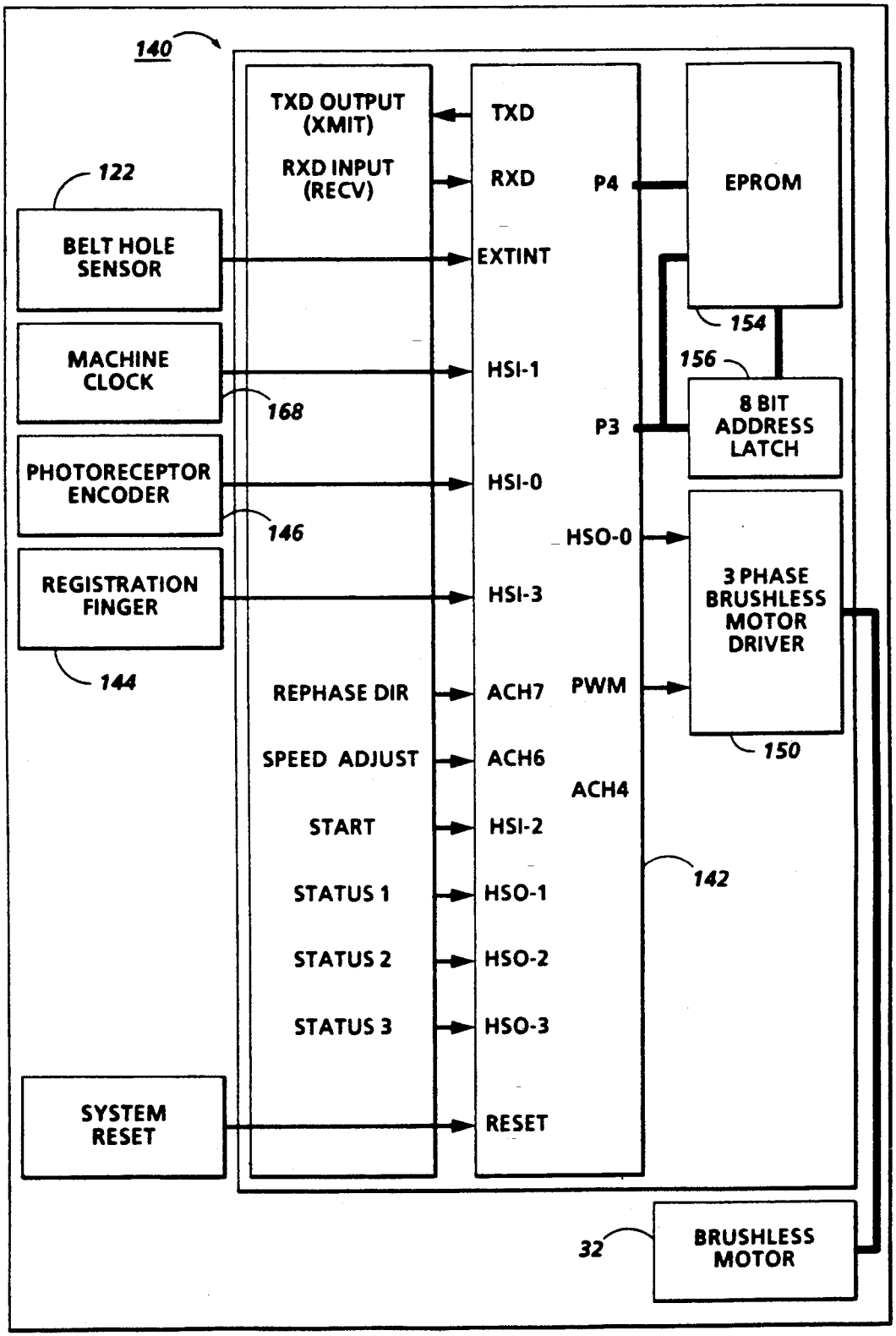
FIG. 4 is a functional block diagram illustrating the control elements and interconnections associated with the photoreceptor drive unit.

Referring also to FIGS. 3 and 4, which further illustrate the electrical components and connections of the present invention, belt hole sensor 122 provides a direct interrupt input to photoreceptor servo printed wiring board (PWB) 140, thereby interrupting microcontroller 142, preferably an Intel ® 8098 ® microcontroller, via the external interrupt (EXTINT). In addition, registration fingers switch 144, which is coupled to registration fingers 110*a, b*, is connected to high speed interrupt No. 3 (HSI-3) on the microcontroller, thereby enabling the recording of the "time" at which each registration fingers signal is received by microcontroller 142. The output of photoreceptor encoder 146, coupled to drive roller 26, is also input as an interrupt to microcontroller 142, via high speed input No. 0 (HSI-0), and periodically indicates the change in position of photoreceptor belt 20.

Also contained on PWB 140 is motor driver 150, preferably a Sprague ® UDN 2936-120 driver, which provides the interface between microcontroller 142 and the three phase brushless servomotor, via the microcontroller 8-bit pulse width modulator (PWM) 152. Although not show, brushless DC motor 32 is controlled by the selective energization of two of the existing three coils in the motor at any specific time. By selectively altering the coil pairs that are energized the motor is caused to rotate. In addition, signals from Hall effect sensors, contained within motor 32, are monitored by motor driver 150 to determine which coil pairs should be energized. The speed at which motor driver 150 causes motor 32 to operate is controlled by the output of PWM 152 in a conventional manner.

EPROM 154 and address latch 156 are also contained on PWB 140, and enable microcontroller 142 to operate on programmed instructions contained within the EPROM. EPROM 154 contains instructions enabling the microcontroller to carry out the velocity position control method illustrated by control blocks 158, 160, 162, and 164 of FIG. 3. More specifically, block 158 continuously measures the velocity of belt 20, using the encoder input on HSI-0. HSI-0 is used as a clock input to the High Speed Interrupt block of the 8098 microcontroller. Preferably, the input signal is provided from photoreceptor drive encoder 146 which is coupled to photoreceptor servo motor 32 which drives the photoreceptor via drive roll 26. Subsequently, the measured digital velocity, output from block 158, is summed at block 162 with the desired velocity output from velocity command block 160, the result being input to digital compensation block 164. Digital compensation block 164 operates on the difference signal input to it, and provides an output to the PWM which directly regulates the velocity of motor 32.

Figure 5:
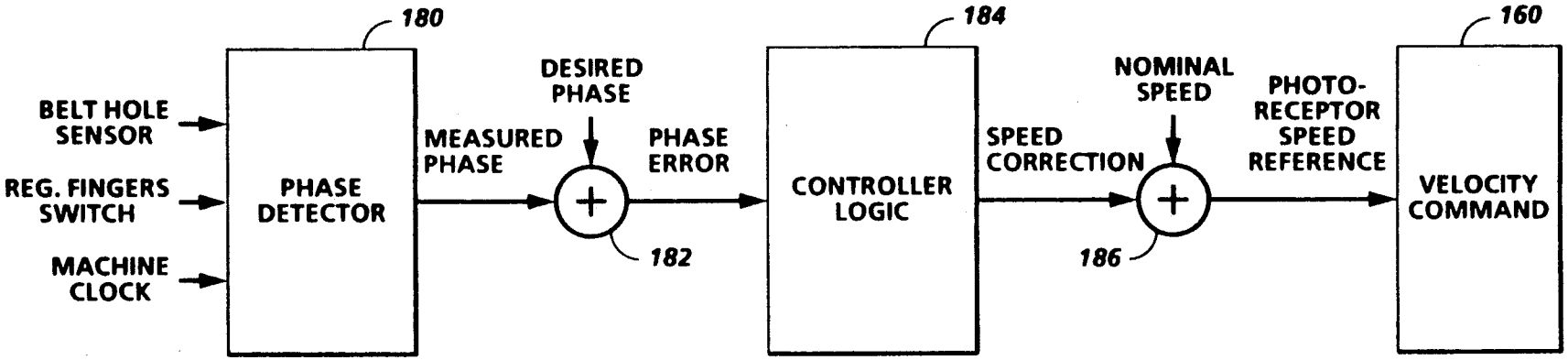
FIG. 5 is a block diagram illustrating the control operations directly associated with the photoreceptor.

Referring now to FIG. 5, which illustrates the control blocks associated with controlling the location of photoreceptor seam 118 in relation to the interdocument zone, IDZ 126, execution of the control scheme depicted in the figure is carried out in microcontroller 142 of FIG. 4. Reference is also made to the timing diagram of FIG. 6A, which shows the relationship between the signals input to the microcontroller. Initially, the input signals from belt hole sensor 122, and registration fingers switch 142, are received by microcontroller 142. Using machine clock input 168, FIG. 4, as a time reference, phase detector block 180 determines the delay (FIG. 6A), in machine clock pulses, from the leading edge of belt hole sensor input 210 to the leading edge of the next registration fingers switch pulse, 212. In one embodiment, the delay is measured using a memory location which is zeroed upon the valid detection of the belt hole, and incremented by each succeeding machine clock interrupt pulse, thereby maintaining an accurate count of the elapsed machine clocks. Alternatively, the delay may be measured with any software or hardware type counters responsive to the machine clock signal. Phase detector block 180 subsequently outputs the delay value, which is added with the desired phase value at adder block 182 to produce a phase error value according to the following equation:

$$\text{Phase Error} = 401 - \text{delay},$$

where 401 is the number of machine clock pulses that would normally occur when seam 118 lies in the center of IDZ 126.

The phase error value is then passed to controller logic block 184, where a control algorithm, preferably a proportional integrating algorithm, is used to determine the correction necessary in the speed of photoreceptor belt 20 to correct for the phase error. Subsequently, controller logic block 184 outputs a speed correction value which is added to the nominal speed value at adder block 186. The output from adder block 186, the photoreceptor speed reference value, is an input to velocity command block 160.

As illustrated in FIG. 6B, the photoreceptor speed is generally controlled to cause photoreceptor encoder 146 to produce an output of approximately 1309 cycles/sec, which represents the process speed of the photoreceptor. During normal operation, phase correction is accomplished by software called Electronic Phase Control (EPC). During this time, should the phase error be positive and increasing, the velocity of the photoreceptor will be incremented while the interdocument zone is passing through the imaging station B of FIG. 1. Similarly, if the phase error is negative and increasing, the velocity of the photoreceptor will be decremented during that time. Additionally a gross phase error correction algorithm call Initial Phase Alignment (IPA) is provided. It allows for large corrections in phase error that occur during startup/initialization. The IPA will set the reference velocity between 1000 and 1700 cycles per second until all the phase error has been corrected for, Velocity profile 240 in FIG. 6B shows a typical correction profile when the phase error is a large positive number. Similarly, velocity profile 242 in FIG. 6B shows a typical correction profile when the phase error is a large negative number. The reference speed is then reset to the nominal of 1309 and EPC is then activated.

Referring now to FIGS. 8A and 8B, in conjunction with Appendices A, B, C and D, where the flowcharts illustrate the operations associated with controlling the phase relationship. More specifically, Appendix A is the code listing for the MAIN1 module executed by microcontroller 142, which contains the control loop for the the photoreceptor drive motor 32. Appendix B contains the code listings for the INC_POS_ERROR module which is called by the MAIN1 module to maintain the phase, or positional relationship between the seam and the interdocument zones. Appendix C contains the listings for the MOTOR_IO module which details the machine instructions associated with the interrupts and other I/O functions of microcontroller 142. Finally, Appendix D contains the code listings associated with the GENMOT module, including the various branches of the MOT_SEQUENCER routine, which enable microntroller 142 to interface with motor driver 150 via the pulse width modulator outputs.

FIG. 8A details the steps associated with the initial establishment of the phase relationship whenever the rotation of photoreceptor belt 20 is begun. Beginning at start block 300, microcontroller 142 analyzes the status of the HSI_STATUS to determine if the MOTOR_ON bit is cleared. If not, the motor is expected to be running and the phase relationship to be maintained. Cycle-up block 302 is executed whenever the BELT_STATUS, INIT_FLAG bit is cleared, by calling the MOT_SEQUENCE procedure. The MOT_SEQUENCER procedure begins execution at the MOT_INIT: label. Subsequently, rotation of the servomotor is begun via motor driver 150 of FIG. 4, as shown by block 304. An initialization delay is executed, block 306, by the STANDBY and MOTOR_OL branches of the MOT_SEQUENCER procedure. Generally, these branches enable the servomotor to reach the nominal operating speed. As indicated in the code listings of the Appendices, the motor speed and phase relationship are generally maintained via the software loop which begins at the SERVICE_MOTOR: label (Appendix B).

Following the initialization of the servomotor, microcontroller 142 executes a series of operations designed to establish the desired phase relationship between seam 118, as indicated by belt hole 120, and the interdocument zones 126. Block 308 continuously checks for the signal from belt hole sensor 122, via the external interrupt (EXTINT), and once detected, reinitializes the value of SPEED_CNTR to zero, which is represented by block 312. Subsequently, the SPEED_CNTR variable is incremented for each machine clock input on microcontroller pin HSI-1. When the next registration fingers signal is received, from switch 142, as detected by test block 314, the value of SPEED_CNTR is copied to the MC_COUNT variable, thereby recording the actual number of machine clocks (mc) elapsed since the belt hole was sensed. As indicated by block 316, the measurement is made, thereby allowing the operations of block 318 to determine the phase error value (PHASE_ERROR). As illustrated in Appendix B at label ERR_CALC:, the MC_COUNT value is subtracted from 401, and the result becomes the PHASE_ERROR value.

Figure 7A:
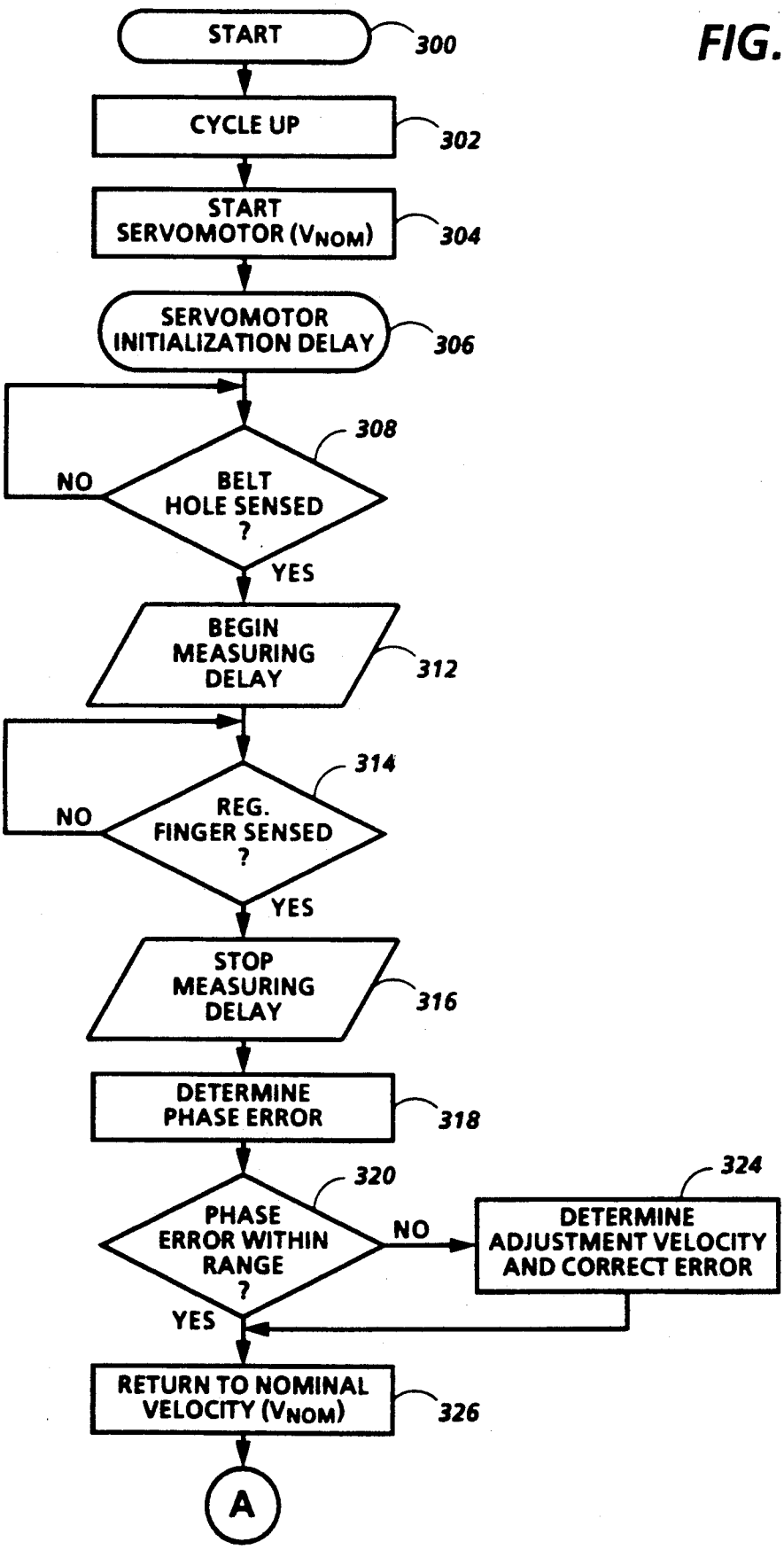
FIGS. 7A and 7B are flowcharts of the control processes used to initially position the photoreceptor seam, and to maintain the position of the seam with respect to the interdocument zone, respectively.

After determining the phase error, the system then determines whether the magnitude of the error is within acceptable limits, block 320. If so, the Electronic Phase Control (EPC) is enabled by returning to the nominal velocity block, 326, and continuing execution of the EPC process of FIG. 7B. Otherwise, the Initial Phase Alignment (IPA) process of FIG. 7A is continued. In IPA process block 324, the error is first converted from machine clocks to photoreceptor clocks, since the closed loop algorithm tracks photoreceptor clocks. Secondly, the new reference speed is chosen to make up all of the position error within a one second profile. If this new reference speed is outside the range of 1000 HZ to 1700 HZ then a second reference speed is chosen which will make up all of the position within 2 seconds. Similarly, if the second reference speed is outside the 1000 HZ to 1700 HZ range, then a velocity profile and third reference speed is chosen that will correct for the position error within 3 seconds. Control is then passed to the EPC process shown in FIG. 7B.

Figure 7B:
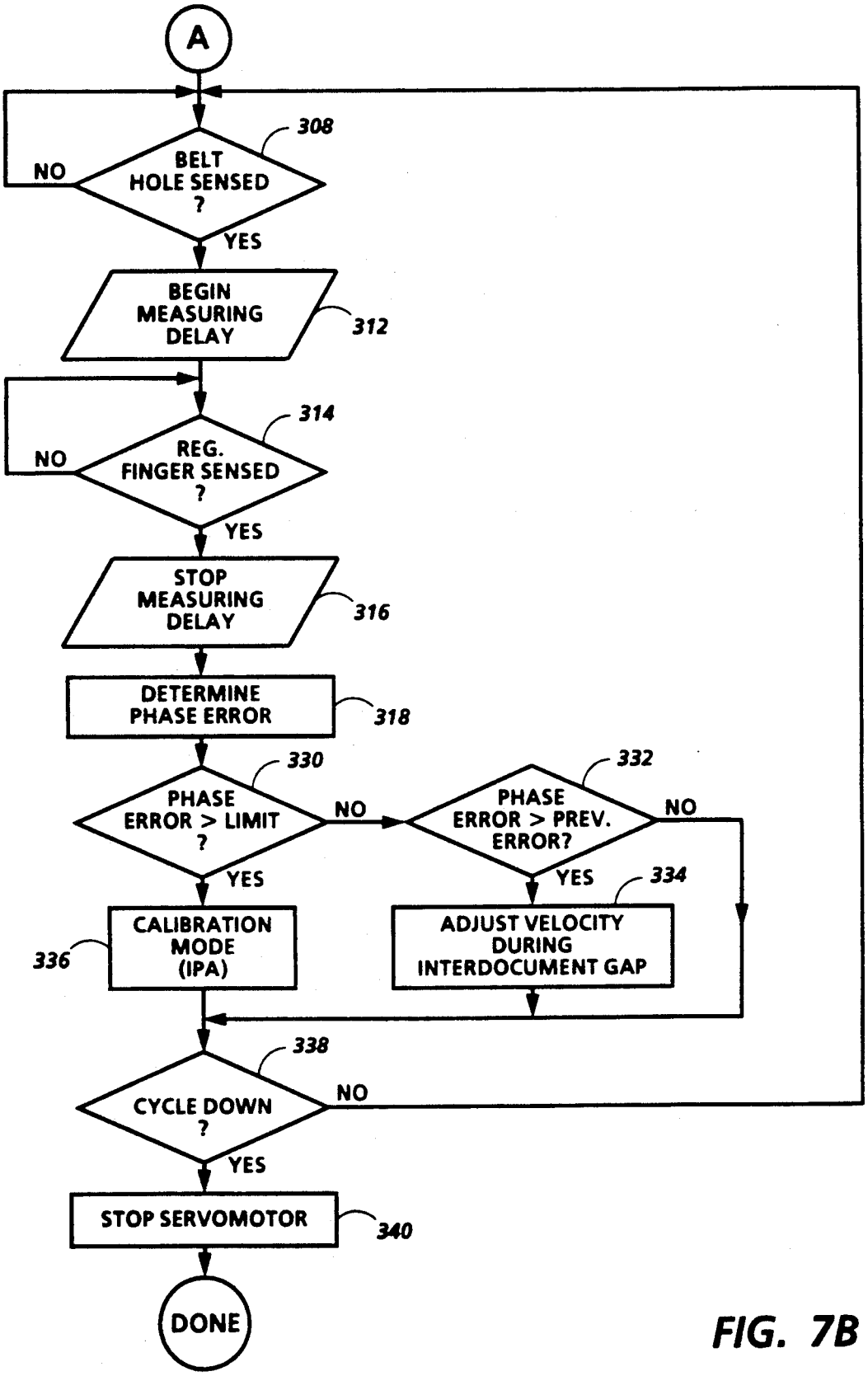

In the Electronic Phase Control mode of FIG. 7B, phase error is calculated once per photoreceptor belt revolution, as illustrated by blocks 308 through 318. Subsequently, if the phase error is less than ±3 machine clocks the ref speed, NEW_REF_VALUE, is not altered, as illustrated by negative responses at blocks 330 and 332. If the absolute value of the phase error is greater than 3 machine clocks, but less than 30 machine clocks, the differential phase error, the present phase minus the phase measured from the previous correction, is determined. If the differential phase error is greater than three, and the absolute phase error is increasing, as detected by block 332, then the velocity is incremented or decremented to minimize that phase error, block 334.

Otherwise, the error is beyond reasonably correctable range, and the system must go into a nonfunctional or calibration mode, IPA block 336, to enable the reestablishment of the phase relationship. More specifically, block 336 represents the execution of two routines, the first being the code beginning at the CHECK_MC_COUNT: label, where the variation in the belt speed is reviewed, and the second being the reestablishment of the phase relationship, beginning once again with block 300 of FIG. A.

Having determined a valid NEW_REF_VALUE for the acceleration of the motor, during the IDZ, processing continues at block 338, where the microcontroller determines if operation of the motor is still required by the larger system. As in block 302 of FIG. 8A, this is determined by analyzing the MOTOR_ON bit of the HSI_STATUS input register. Should the bit be cleared, processing would continue at the STOP_THE_MOTOR: label of Appendix A, as represented by block 340. Otherwise, the looping structure of the control software enables the continuous monitoring of the phase relationship, once per belt revolution, to enable control of the relative delay between the belt hole sensor pulse and the registration fingers switch pulse, thereby controlling the relationship between the belt seam and the interdocument zones, and keeping the seam out of the exposed image areas on the photoreceptor.

In recapitulation, the latent image recorded on the photoconductive surface has charged image or document areas and interdocument zones therebetween. The phase control method and apparatus of the present invention enable the adjustment of the photoreceptor speed, while the interdocument zones travel through the imaging station, to compensate for any irregularities in the speed of the photoreceptor belt or the advancing copy sheet. The periodic adjustment to the photoreceptor speed does not impact the image quality of the system, but does provide the system with a means for correcting for the variations which are inherent in such systems.

It is, therefore, apparent that there has been provided in accordance with the present invention, a control apparatus and method for use in an electrophotographic printing or reprographic machine that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and broad scope of the appended claims.

Appendix A

```
$DEBUG
$PAGELENGTH(50)

MAIN1          MODULE          MAIN,STACKSIZE(08)
;Copyright (c) 1989,1990,1991 Xerox Corporation. All Rights Reserved.

$NOLIST
$INCLUDE (SYM96.INC)
$INCLUDE (B1APP96.INC)
$INCLUDE (B1VALUES.INC)
$LIST

      RSEG     AT 0D1H

NEW_REF_VALUE:          DSW          1 ;REG FOR MOST CURRENT REF FREQ
DEBUG_REG:              DSW          1 ;USED FOR DEBUG WITH SER COMM
APP_ERROR:              DSB          1 ;REG FOR APP ERRORS

DEBUG_REG_LO            EQU          DEBUG_REG
DEBUG_REG_HI            EQU          DEBUG_REG + 1

      RSEG

PR_POS_CNTR:            DSW          1 ;POSITION CNTR FOR PR CLOCKS
MC_POS_CNTR:            DSW          1 ;POSITION CNTR FOR MACHINE CLOCKS
PREV_POS_ERR:           DSW          1 ;TEMP BUFFER FOR POS ERROR
MC_TIME:                DSW          1 ;TIME STAMP OF ENCODER EDGE
PREV_MC_TIME:           DSW          1 ;PREV MC TIME STAMP
MSEC_DELAY:             DSW          1 ;COUNTER FOR 1MSEC TICKS
NUMBER_OF_MC:           DSW          1 ;# OF MC SINCE LAST SPEED CALC
ERROR_BUF:              DSW          1 ;BUFFER FOR POS ERROR
MC_REF:                 DSW          1 ;MC SPEED(CALCULATED)
ERROR_TIME:             DSW          1
MC_COUNT:               DSW          1
MC_ERROR:               DSW          1
MC_BUFF:                DSW          1 ;TEMP STORE BUFF FOR MC/REV
TEMP_MC_BUFF:           DSW          1
BELT_TIMER:             DSW          1 ;HOLDS # OF 1 MSEC TICKS/BELT REV
TEMP1:                  DSW          1
TEMP2:                  DSW          1

BELT_STATUS:            DSB          1 ;GEN PURPOSE STATUS FLAGS
;APP_ERROR:             DSB          1 ;REGISTER FOR APPLICATION ERROR FLAGS
SLOW_CNTR:              DSB          1 ;COUNTER FOR TOO SLOW ERRORS
FAST_CNTR:              DSB          1 ;COUNTER FOR TOO FAST ERRORS
PULSE_LENGTH:           DSB          1
```

```
        RSEG

NEG_ONE                 EQU             0FFFFH
RAM_START  EQU          001AH

ENC_POS_FRA:            DSW             1
ENC_PREV_POS_FRA:       DSW             1
ENC_POS_INT:            DSB             1
ENC_PREV_POS_INT:       DSB             1
ENC_INC_POS:            DSW             1

REF_POS_FRA:            DSW             1
REF_PREV_POS_FRA:       DSW             1
REF_POS_INT:            DSB             1
REF_PREV_POS_INT:       DSB             1
REF_INC_POS:            DSW             1

MOTOR_OUT_WORD:         DSW             1
MOTOR_COMMAND           EQU             MOTOR_OUT_WORD + 1          :BYTE

PWM_NOMINAL:            DSW             1
ACCEL_DECEL_RATE:       DSW             1
DES_HZ:                 DSW             1
MOT_DIST_CNT:           DSW             1


STATE_PTR:              DSW             1
STATUS_FLAG0:           DSB             1
STATUS_FLAG1:           DSB             1
COMMAND_FLAG0:          DSB             1
IOC0_SHADOW:            DSB             1
;IOC1_SHADOW:           DSB             1
PORT0_SHADOW:           DSB             1

        PUBLIC  ENC_INC_POS, ENC_POS_INT, ENC_POS_FRA, ENC_PREV_POS_INT
        PUBLIC  REF_INC_POS, REF_POS_INT, REF_POS_FRA

        PUBLIC  DES_HZ, ACCEL_DECEL_RATE, STATE_PTR, PWM_NOMINAL, MOT_DIST_CNT
        PUBLIC  MOTOR_COMMAND,DEBUG_REG,DEBUG_REG_LO,DEBUG_REG_HI
        PUBLIC  IOC0_SHADOW, PORT0_SHADOW, STATUS_FLAG0, STATUS_FLAG1, COMMAND_FLAG0

        PUBLIC  BELT_STATUS,TEMP1,TEMP2
        PUBLIC  PR_POS_CNTR,MC_POS_CNTR,MC_BUFF
        PUBLIC  MC_TIME,PREV_MC_TIME
        PUBLIC  NUMBER_OF_MC,MSEC_DELAY,NEW_REF_VALUE
        PUBLIC  ERROR_TIME,ERROR_BUF,MC_REF,NEW_REF_VALUE
        PUBLIC  MC_COUNT,MC_ERROR,SLOW_CNTR,FAST_CNTR
        PUBLIC TEMP_MC_BUFF,APP_ERROR,BELT_TIMER,PULSE_LENGTH
;       PUBLIC  PREV_COMP_N,PREV_COMP_OUT

        EXTRN   COMP_IN_MANT, COMP_IN_EXP,SPEED_CNTR,POS_BYTE
        EXTRN   COMP_OUT_MANT, COMP_OUT_EXP,MODE_REG,REG_CNTR
        EXTRN   PREV_PHASE_ERROR,PHASE_ERROR,SPEED_ADJ_CNTR
        EXTRN   ENC_PERIOD, REF_PERIOD, BELT_HOLE_COUNT,BELT_LOCKOUT_TMR


        CSEG    AT              2080H

        PUBLIC  START_SHUTDOWN
        EXTRN   INC_POS_ERROR

        EXTRN   COMPENSATOR, COMP_GAIN_ONLY
        EXTRN   INTERRUPT_INIT
        EXTRN   MOT_INIT, STANDBY, MOT_OL, MOT_SEQUENCER
```

```
        EXTRN   CALC_SAMPLE_COUNTS
        EXTRN   COMM_INIT
        EXTRN   CK_SER_COMM
        EXTRN   SEND_COMM

START:
        DI                                          ;disable all interrupts
        LD      RAM_START, #0100H
REP_CONTINUE:
        LD      SP, #STACK                          ;set up the stack pointer
;       LD      SP,#100H
        PUSH    0                                   ;clear all of the flags
        POPF
        CLRB    INT_PENDING                         ;clear all pending interrpts
        CLRB    INT_MASK                            ;individually disable the interrupts
        LDB     HSO_COMMAND, #DISABLE_AMP           ;disable the power amplifier
        ADD     HSO_TIME, TIMER1, #4
CLEAR_RAM:
        SUB     RAM_START, #0002
        ST      ZERO,[RAM_START]
        CMP     RAM_START, ZERO
        BNE     CLEAR_RAM
        CALL    CALC_SAMPLE_COUNTS                  ;from sample time determine # of timer counts
SET_REFERENCE:
        LDB     PWM_CONTROL, #080H                  ;set out a 50% duty cycle on the PWM pin
        LDB     IOC1, #00100001B                    ;allow PWM output &ENABLE TXD
        LD      STATE_PTR, #MOT_INIT
        LD      ACCEL_DECEL_RATE, #EXP_RATE
        LD      NEW_REF_VALUE, #REF_FREQUENCY
        LDB     PORT0_SHADOW, PORT0
        CALL    INTERRUPT_INIT
        CALL    COMM_INIT
        BBS     PORT0_SHADOW,DIAG,DIAGNOSTICS
        LD      NEW_REF_VALUE,#REF_FREQUENCY
SERVICE_MOTOR:
        LD      PORT0_SHADOW,PORT0
        BBS     PORT0_SHADOW,DIAG,START_SHUTDOWN                    ;CHECK FOR DIAG MODE
        BBC     STATUS_FLAG1, SAMPLE_TIME_BIT, SERVICE_MOTOR        ;check the sample time
interrupt
        CALL    SERV_SAMPLE
        CALL    WATCHDOG_TIMER
        CALL    CK_SER_COMM
        LD      PORT0_SHADOW,PORT0
        BBS     PORT0_SHADOW,DIAG,START_SHUTDOWN
        BBS     POS_BYTE,BELT_CHECK_DISAB,CHECK_SWITCH
        CALL    BELT_HOLE_CHECK
CHECK_SWITCH:
        BBC     HSI_STATUS, MOTOR_ON, STOP_THE_MOTOR        ;check for stop mode
        LDB     COMMAND_FLAG0, #00000100B                   ;load no INTERNAL error checking
        LD      DES_HZ,NEW_REF_VALUE
        BBC     BELT_STATUS,INIT_FLAG,DO_SEQUENCE
        CALL    CHECK_INPUTS
        CALL    ERROR_CHECK                                 ;CHECK FOR APPILCATION ERRORS
        CALL    MC_SPEED_CHECK
        CALL    INC_POS_ERROR
        BR      DO_SEQUENCE

STOP_THE_MOTOR:
        CMPB    APP_ERROR,#0
        JE      CLEAR_REGISTERS
CLEAR_REGISTERS:
        CLR     DES_HZ
        CLR     BELT_TIMER
        CLR     MSEC_DELAY
```

```
        CLR     SPEED_CNTR
        CLR     PREV_PHASE_ERROR
        CLR     TEMP_MC_BUFF
        CLR     MC_POS_CNTR
        CLR     PR_POS_CNTR
        CLR     SPEED_ADJ_CNTR
        CLRB    MODE_REG
;       CLRB    APP_ERROR
        CLR     NUMBER_OF_MC
        CLRB    REG_CNTR
        CLRB    FAST_CNTR
        CLRB    SLOW_CNTR
        CLRB    POS_BYTE
        CLRB    PULSE_LENGTH
        ANDB    BELT_STATUS,#00000000B          ;CLEAR ALL FLAGS
        ANDB    APP_ERROR,#01000000B            ;CLEAR ALL FLAGS EXCEPT EXCEPT HSO_IS_SET
DO_SEQUENCE:
        CALL    MOT_SEQUENCER
        BR      SERVICE_MOTOR


DIAGNOSTICS:
;       BBC     HSI_STATUS, DIAG, START_SHUTDOWN
        BBC     STATUS_FLAG1, SAMPLE_TIME_BIT, DIAGNOSTICS
        DI
        LDB     HSO_COMMAND, #DISABLE_AMP
        BBC     HSI_STATUS, MOTOR_ON, HSO_CMND_LOADED
        LDB     HSO_COMMAND, #ENABLE_AMP
HSO_CMND_LOADED:
        ADD     HSO_TIME, TIMER1, #04
        EI
        CALL    SERV_SAMPLE
        BBC     PORT0_SHADOW,DIAG,START_SHUTDOWN
        DI
        LDB     HSO_COMMAND, #00000011B         ;signal end of processing time
        ADD     HSO_TIME, TIMER1, #04
        EI
        BR      DIAGNOSTICS
$EJECT
;*****************************************************************************
;ROUTINE:SERV_SAMPLE
;DESCRIPTION:
;*****************************************************************************
SERV_SAMPLE:
        ANDB    STATUS_FLAG1, #CLR_SAMPLE_BIT   ;clear sample time tick
        LDB     PORT0_SHADOW, PORT0
        LDB     IOC0, IOC0_SHADOW
        CALL    ENC_INC_POSITION                ;determine the motor velocity
IF TRACKING EQ 1
        CALL    REF_INC_POSITION                ;determine the velocity to track to
ENDIF
        SUB     COMP_IN_MANT, REF_INC_POS, ENC_INC_POS
;       BR      START                           ;RE INITIALIZE IF FAULTS OCCURRED
;       BBS     HSI_STATUS, DIAG, SERV_SAMP_DIAG
        BBS     PORT0_SHADOW,7,SERV_SAMP_DIAG
        BBC     STATUS_FLAG1, CL_CONTROL, SERV_RETURN
        BBS     STATUS_FLAG1, CL_FULL_COMP, SERV_SAMP_DIAG
        CALL    COMP_GAIN_ONLY
        BR      SERV_COMP
SERV_SAMP_DIAG:
        CALL    COMPENSATOR
;       BBC     HSI_STATUS, DIAG, SERV_COMP     ;if in diagnostic mode
        BBC     PORT0_SHADOW,7,SERV_COMP
        CLR     COMP_OUT_MANT                   ;then compensator block = zero
```

```
SERV_COMP:
     CALL     OUT_TO_PWM                          ;send compensator word to the PWM
SERV_RETURN:
     RET
;*****************************************************************************
;ROUTINE:ENC_INC_POSITION
;DESCRIPTION:- THIS ROUTINE CALCULATES THE INCREMENTAL POSITION DISPLACEMENT
;BETWEEN THE CURRENT AND LAST TIME SAMPLES. THE INCREMENTAL POSITION CONSISTS OF TWO
;PARTS, AN INTEGER PART AND A FRACTIONAL PART. THE INTEGER PART REPRESENTS THE INTEGRAL NUMBER
;OF ENCODER PULSES BETWEEN TIME SAMPLES. THE FRACTIONAL PART IS THE TIME DIFFERENCE BETWEEN
;LAST RISING EDGE OF THE ENCODER AND THE SAMPLE TIME DIVIDED BY THE
;ENCODER PERIOD.
;*****************************************************************************
ENC_INC_POSITION:
     CMP      ENC_POS_FRA, #00
     BLT      ENC_FRACT_NEG
     CMP      ENC_POS_FRA, ENC_PERIOD
     BLT      ENC_FRACT_NO_OVER
ENC_FRACT_OVER:
     CLR      ENC_POS_FRA     ;CLEAR FRACT PART ANS INCREMENT
     INCB     ENC_POS_INT     ;INTEGER PORTION IF FRA GREATER THAN PERIOD
     BR       CALC_ENC_POS
ENC_FRACT_NEG:
     DECB     ENC_POS_INT
     ADD      ENC_POS_FRA, ENC_PERIOD
     CMP      ENC_POS_FRA, #00
     BGT      ENC_FRACT_NO_OVER
     CLR      ENC_POS_FRA
ENC_FRACT_NO_OVER:
     MULU     AXL, ENC_POS_FRA, #ENCODER_MULT
     DIVU     AXL, ENC_PERIOD
     LD       ENC_POS_FRA, AXW
CALC_ENC_POS:
     SUBB     AXLB, ENC_POS_INT, ENC_PREV_POS_INT          ;STORE INCR POS INTEGER IN AXLB
     CMPB     AXLB, #(32000/ENCODER_MULT)
     BLT      ENC_OK
;    BBS      HSI_STATUS, DIAG, ENC_OK
     BBS      PORT0_SHADOW,DIAG,ENC_OK
     BBC      STATUS_FLAG1, CL_CONTROL, ENC_OK
     BBS      COMMAND_FLAG0, NO_ERROR_CHECK, ENC_OK
     BBC      STATUS_FLAG0, NO_EXT_MODULATE, ENC_OK
     ORB      STATUS_FLAG0, #ERROR_STATE
     BR       START_SHUTDOWN
ENC_OK:
     CLRB     AXHB
     MUL      AXL, #ENCODER_MULT
     SUB      CXW, ENC_POS_FRA, ENC_PREV_POS_FRA           ;STORE FRACTIONAL PART OF INCR
POS IN CXW
     ADD      ENC_INC_POS, AXW, CXW                        ;ADD INTEGER & FRACT PARTS
     LDB      ENC_PREV_POS_INT, ENC_POS_INT       ;STORE CURRENT INTEG & FRACT PARTS
     LD       ENC_PREV_POS_FRA, ENC_POS_FRA
     RET
$EJECT
;*****************************************************************************
;ROUTINE:REF_INC_POSITION
;DESCRIPTION:CALCULATES THE INCREMENTAL POSITION DISPLACEMENT OF THE REFERENCE ENCODER
;USING THE SAME ALGORITHIM THAT IS USED FOR THE OUTPUT ENCODER. AN INTERNALLY GENERATATED
;REFERENCE HAS TO BE SET IF THERE IS NOT A PHYSICAL REFERENCE ENCODER.
;*****************************************************************************
REF_INC_POSITION:
     CMP      REF_POS_FRA, #00
     BLT      REF_FRACT_NEG
     CMP      REF_POS_FRA, REF_PERIOD
     BLT      REF_FRACT_NO_OVER
```

```
REF_FRACT_OVER:
      CLR     REF_POS_FRA
      INCB    REF_POS_INT
      BR      CALC_REF_POS
REF_FRACT_NEG:
      DECB    REF_POS_INT
      ADD     REF_POS_FRA, REF_PERIOD
      CMP     REF_POS_FRA, #00
      BGT     REF_FRACT_NO_OVER
      CLR     REF_POS_FRA
REF_FRACT_NO_OVER:
      MULU    AXL, REF_POS_FRA, #REF_MULT
      DIVU    AXL, REF_PERIOD
      LD      REF_POS_FRA, AXL
CALC_REF_POS:
      SUBB    AXLB, REF_POS_INT, REF_PREV_POS_INT
      CLRB    AXHB
      MUL     AXL, #REF_MULT
      SUB     CXW, REF_POS_FRA, REF_PREV_POS_FRA
      ADD     REF_INC_POS, AXW, CXW
      LDB     REF_PREV_POS_INT, REF_POS_INT
      LD      REF_PREV_POS_FRA, REF_POS_FRA
      RET
$EJECT
;*****************************************************************************
;ROUTINE:
;DESCRIPTION:
;*****************************************************************************
OUT_TO_PWM:
      LDB     AD_COMMAND, #(8 + AD_CHANNEL)     ;start a/d conversion on channel 5
      ORB     STATUS_FLAG0, #ANALOG_INACTIVE    ;assume no analog input
      LD      MOTOR_OUT_WORD, COMP_OUT_MANT
      CMP     MOTOR_OUT_WORD, #7F7FH
      BLT     COMP_ROUND_UP
      LD      MOTOR_OUT_WORD, #7FFFH
      BR      WAIT_FOR_CONV
COMP_ROUND_UP:
      ADD     MOTOR_OUT_WORD, #80H              ;ROUND OFF THE NUMBER
      ADD     MOTOR_OUT_WORD, PWM_NOMINAL
      BNV     WAIT_FOR_CONV
      CALL    MAX_PWM_WORD
WAIT_FOR_CONV:
      BBS     COMMAND_FLAG0, NO_EXT_MODULATE, CHECK_PWM_SIGN
      LDB     AXLB, AD_RESULT_LO
      BBS     AXLB, 3, WAIT_FOR_CONV
      SUBB    AXHB, AD_RESULT_HI, #80H
      CMPB    AXHB, #75                         ;COMPARE TO 1.5 VOLT OFFSET
      BGT     CHECK_PWM_SIGN
      CMPB    AXHB, #-75                        ;COMPARE TO -1.5 VOLT OFFSET
      BLT     CHECK_PWM_SIGN
DEBUG:
      ANDB    STATUS_FLAG0, #ANALOG_ACTIVE      ;flag analog input, disable overflow protection
      ANDB    STATUS_FLAG1, #CL_NOT_SS
      ADD     MOTOR_OUT_WORD, AXW
      BNV     CHECK_PWM_SIGN
      CALL    MAX_PWM_WORD
CHECK_PWM_SIGN:
;     BBS     HSI_STATUS, DIAG, LOAD_PWM_WORD
      BBS     PORT0_SHADOW,DIAG,LOAD_PWM_WORD
      CMPB    MOTOR_COMMAND, #-PWM_OFFSET/2
      BGE     LOAD_PWM_WORD
      LDB     MOTOR_COMMAND, #-PWM_OFFSET/2
```

```
LOAD_PWM_WORD:
      BBC     STATUS_FLAG0, DIR, NO_NEG_PWM
      NEG     MOTOR_OUT_WORD
      BNV     NO_NEG_PWM                          ;don't output the new PWM
      CALL    MAX_PWM_WORD
NO_NEG_PWM:
      ADD     MOTOR_OUT_WORD, #8000H              ;OFFSET THE COMMAND FOR PWM
      LDB     PWM_CONTROL, MOTOR_COMMAND
      RET

MAX_PWM_WORD:
      CMP     MOTOR_OUT_WORD, #0000H
      BLT     MAX_POS_WORD
MAX_NEG_WORD:
      LD      MOTOR_OUT_WORD, #-7FFFH
      RET
MAX_POS_WORD:
      LD      MOTOR_OUT_WORD, #7FFFH
      RET


START_SHUTDOWN:
      DI
      CLRB    INT_MASK
      CLRB    INT_PENDING
      LD      STATE_PTR, #MOT_INIT                ;initialize everything
      LDB     PWM_CONTROL, #80H
      CALL    WATCHDOG_TIMER                      ;CLEAR WDT
      BBC     STATUS_FLAG0, ERROR_STATUS, GO_TO_START
ERROR_OFF:
      BBS     HSI_STATUS, MOTOR_ON, ERROR_OFF
GO_TO_START:
      DI
      LD      RAM_START, #0100H
      BR      REP_CONTINUE
$EJECT
;*********************************************************************
;ROUTINE:     MC_SPEED_CHECK
;DESCRIPTION: Calculates the frequency of the incoming machine clock encoder
;             signal. The frequency is determined by measuring the time it takes
;             to complete 75 encoder pulses.
;
;             MC_REF = [(500,000 TIMER TICKS/SEC)*75 MACHINE CLOCKS]/#TIMER
;             TICKS
;
;
;*********************************************************************
MC_SPEED_CHECK:
      BBS     BELT_STATUS,MC_REF_SET,SPEED_EXIT
      CMP     NUMBER_OF_MC,#80                    ;CHECK FOR 80 MC
      BLT     SPEED_EXIT
      LD      BXW,#07H                            ;
      LD      AXW,#0C350H                         ;LD 50,000 in AXW
      DEC     NUMBER_OF_MC
      MULU    NUMBER_OF_MC,#10                    ;10X
      MULU    AXL,NUMBER_OF_MC,AXW
      DIVU    AXL,MC_TIME
      LD      MC_REF,AXW
      CLR     NUMBER_OF_MC
SPEED_DONE:
      ORB     BELT_STATUS,#00000010B              ;SET MC_REF_SET
SPEED_EXIT:
      RET
```

```
SEJECT
;*****************************************************************************
;ROUTINE:
;DESCRIPTION:
;*****************************************************************************

ERROR_CHECK:
      BBC     HSI_STATUS,MOTOR_ON,ERROR_EXIT      ;MAKE SURE MOTOR IS ON
      CMPB    APP_ERROR,#0
      BE      NO_APP_ERRORS
      BBS     APP_ERROR,ERROR_FLAG,ERROR_EXIT     ;JMP IF ERROR ALREADY OCCURRED
      JBC     APP_ERROR,SPEED_FAST,CHECK_SLOW
      ORB     APP_ERROR,#SET_ERROR_FLAG
CHECK_FAST:
      DI
      LDB     HSO_COMMAND,#00100011B              ;SET HSO - 3
      ADD     HSO_TIME,TIMER1,#6
      NOP
      NOP
      LDB     HSO_COMMAND,#00000010B              ;CLEAR HSO - 2
      ADD     HSO_TIME,TIMER1,#5
      NOP
      NOP
      LDB     HSO_COMMAND,#00100001B              ;SET HSO -1
      ADD     HSO_TIME,TIMER1,#4
      EI
      BR      ERROR_EXIT
CHECK_SLOW:
      JBC     APP_ERROR,SPEED_SLOW,CHECK_MCLOCK
      ORB     APP_ERROR,#SET_ERROR_FLAG
      DI
      LDB     HSO_COMMAND,#00100011B              ;SET HSO - 3
      ADD     HSO_TIME,TIMER1,#6
      NOP
      NOP
      LDB     HSO_COMMAND,#00000010B              ;CLEAR HSO - 2
      ADD     HSO_TIME,TIMER1,#5
      NOP
      NOP
      LDB     HSO_COMMAND,#00000001B              ;CLEAR HSO - 1
      ADD     HSO_TIME,TIMER1,#4
      EI
      BR      ERROR_EXIT
CHECK_MCLOCK:
      JBC     APP_ERROR,NO_MCLOCK,CHECK_BELT_HOLE
      ORB     APP_ERROR,#SET_ERROR_FLAG
      DI
      LDB     HSO_COMMAND,#00000111B              ;CLR HSO 2 & 3
      ADD     HSO_TIME,TIMER1,#5
      NOP
      NOP
      LDB     HSO_COMMAND,#00100001B              ;SET HSO - 1
      ADD     HSO_TIME,TIMER1,#4
      EI
      BR      ERROR_EXIT
CHECK_BELT_HOLE:
      JBC     APP_ERROR,NO_BELT_HOLE,CHECK_REG_SWITCH
      ORB     APP_ERROR,#SET_ERROR_FLAG
      DI
      LDB     HSO_COMMAND,#00000011B              ;CLEAR HSO-3
      ADD     HSO_TIME,TIMER1,#6
      NOP
      NOP
      LDB     HSO_COMMAND,#00100010B              ;SET HSO_2
      ADD     HSO_TIME,TIMER1,#5
```

```
        NOP
        NOP
        LDB     HSO_COMMAND,#00000001B          ;CLEAR HSO-1
        ADD     HSO_tIME,TIMER1,#4
        EI
        BR      ERROR_EXIT
CHECK_REG_SWITCH:
        NOP
        ORB     APP_ERROR,#SET_ERROR_FLAG
        DI
        LDB     HSO_COMMAND,#00000011B          ;CLEAR HSO-3
        ADD     HSO_TIME,TIMER1,#6
        NOP
        NOP
        LDB     HSO_COMMAND,#00100010B          ;SET HSO-2
        ADD     HSO_TIME,TIMER1,#5
        NOP
        NOP
        LDB     HSO_COMMAND,#00100001B          ;SET HSO-1
        ADD     HSO_TIME,TIMER1,#4
        EI
        BR      ERROR_EXIT
NO_APP_ERRORS:
        NOP
        BBS     APP_ERROR,HSO_IS_SET,ERROR_EXIT
        DI
        LDB     HSO_COMMAND,#00000111B          ;CLR HSO 2 & 3
        ADD     HSO_TIME,TIMER1,#5
        NOP
        NOP
        LD      HSO_COMMAND,#00000001B          ;CLR HSO 1
        ADD     HSO_TIME,TIMER1,#4
        EI
ERROR_EXIT:
        RET
$EJECT
;
;*****************************************************************************
;ROUTINE:
;DESCRIPTION:
;*****************************************************************************
CHECK_INPUTS:
        BBC     HSI_STATUS,MOTOR_ON,EXIT_CHECK
        ANDB    INT_MASK,#01111111B             ;DISABLE EXT INTR
        CMPB    APP_ERROR,#0
        JNE     EXIT_CHECK                      ;EXIT RTN IF PRIOR ERR
        CMP     BELT_TIMER,#9000                ;CHECK FOR 9 SECOND TIME OUT
        JGT     BELT_HOLE_ERROR
        BBC     BELT_STATUS,FIRST_BHOLE,EXIT_CHECK
        CMP     BELT_TIMER,#3000                ;CHECK IF 3 SEC HAS PASSED
        JLT     EXIT_CHECK
        CMP     SPEED_CNTR,#1000
        JLT     PR_SPEED_ERROR
        CMPB    REG_CNTR,#2
        JLT     REG_SWITCH_ERROR
        BR      EXIT_CHECK
BELT_HOLE_ERROR:
        ORB     APP_ERROR,#00000100B
        BR      EXIT_CHECK
PR_SPEED_ERROR:
        ORB     APP_ERROR,#00010000B
        BR      EXIT_CHECK
REG_SWITCH_ERROR:
        ORB     APP_ERROR,#00001000B
```

```
EXIT_CHECK:
      ORB     INT_MASK,#10000000B                    ;RE-ENABLE EXT INTR
      RET

;*****************************************************************************
;ROUTINE:LOAD_CHECK
;DESCRIPTION: THIS ROUTINE MONITORS THE LOAD VARIATIONS BY CHECKING THE CURRENT BEING
;BEING DRAWN ACROSS A SENSE RESISTOR.THE VOLTAGE ACROSS THE SENSE IS FED TO A/D
;CHANNEL FOUR OF THE PROCESSOR. THE CURRENT IS CALCULATED USING THE FOLLOWING RELATIONSHIP
; 1 AMPERE = 1.6 VOLTS
;
;*****************************************************************************
LOAD_CHECK:
      BBC     BELT_STATUS,INIT,EXIT_LOAD_CHECK
      LDB     AD_COMMAND,#00001100B                  ;START A/D CONV CHAN 4
      NOP
      NOP
AD_CONVERSION:
      LDB     AXLB,AD_RESULT_LO
      BBS     AXLB,3, AD_CONVERSION
      LDB     AXLB,AD_RESULT_LO
      LDB     AXHB,AD_RESULT_HI
      SHR     AXW,#06
;     LD      TEST_REG,AXW
GET_CURRENT:
      CMP     AXW,#1FFH
      JGT     OVER_LOAD
      BR      EXIT_LOAD_CHECK
OVER_LOAD:
      NOP
EXIT_LOAD_CHECK:
      NOP
      RET
;*****************************************************************************
;ROUTINE:WATCHDOG_TIMER
;DESCRIPTION:
;*****************************************************************************
WATCHDOG_TIMER:
      LDB     WATCHDOG,#0E1H                         ;CLEAR WDT
      LDB     WATCHDOG,#01EH                         ;ENABLE WDT
      RET

;*****************************************************************************
;ROUTINE:DEBUG_DATA
;DESCRIPTION:
;*****************************************************************************
DEBUG_DATA:
      BBC     BELT_STATUS,DEBUG_RDY,EXIT_DEBUG
      ANDB    BELT_STATUS,#11011111B                 ;CLEAR DEBUG_RDY BIT
      LD      AXW,#4002H
      ST      PHASE_ERROR,[AXW]
      LD      AXW,#4004H
      ST      MC_BUFF,[AXW]
      LD      AXW,#4006H
      ST      DES_HZ,[AXW]
      LD      AXW,#4008H
;     ST      INC_PR_POS,[AXW]
EXIT_DEBUG:
      RET
;*****************************************************************************
;ROUTINE:BELT_HOLE_CHECK
;DESCRIPTION:THIS ROUTINE POLLS THE BELT HOLE SENSOR ONCE EVERY MILLISECOND.
;         IF A BELT HOLE IS DETECTED A FLAG IS SET AND A COUNTER IS INCREMENTED.
;         A MACHINE CLOCK COUNTER IS ALSO LOADED AT THIS TIME.
;         THE FLAG REMAINS SET UNTIL THE NEXT TIME SAMPLE IS TAKEN. IF THE BELT
```

```
;       HOLE SENSOR IS STILL HIGH THE COUNTER IS INCREMENTED ANF THE FLAG
;       REMAINS SET. IF THE SENSOR IS NOT SET THE FLAG IS CLEARED AND THE PULSE
;       LENGTH AND MACHINE CLOCK COUNTERS ARE CLEARED. THE POLLING PROCESS IS
;       CONTINUED UNTIL THE PULSE LENGTH COUNTER REACHES A VALUE OF 4. AT THE TIME
;       A 50 MSEC TIMER IS STARTED WHICH DISABLES POLLING OF THE SENSOR FOR 50 MS.
;
;TEXEC_MAX:25 USEC
;
;*****************************************************************************
BELT_HOLE_CHECK:

     BBS     POS_BYTE,POLL_MODE,CHECK_SENSOR
     BBC     PORT2,2,EXIT_BELT_CHECK
     ORB     POS_BYTE,#00000010B                ;SET POLL MODE BIT
     LD      TEMP_MC_BUFF,MC_BUFF
     LD      MC_BUFF,SPEED_CNTR
CHECK_SENSOR:
     BBC     PORT2,2,NO_PULSE
     INCB    PULSE_LENGTH                       ;CNT # OF ITERATIONS
     CMPB    PULSE_LENGTH,#12
     JNE     EXIT_BELT_CHECK
     CLRB    PULSE_LENGTH
     ANDB    POS_BYTE,#11111101B                ;CLR POLL MODE BIT

PROCESS_SENSOR:
     BBC     BELT_STATUS,INIT_FLAG,EXIT_BELT_CHECK
     ORB     BELT_STATUS,#00100000B             ;SET DEBUG FLAG
     BBC     BELT_STATUS,POS_ERR_SET,CONTU_BELT_HOLE_CHECK
     BBS     POS_BYTE,REPHASE_ENB,CHECK_ADJUST_STATUS
     ORB     POS_BYTE,#01000000B                ;ENB REPHASE
     BR      CONTU_BELT_HOLE_CHECK
CHECK_ADJUST_STATUS:
;    JBS     POS_BYTE,SPEED_ADJUST_SET,CONTU_BELT_HOLE_CHECK
CONTU_BELT_HOLE_CHECK:
     CLR     BELT_TIMER                         ;BELT ERROR TIMER (9 SEC TIME OUT)
     CLRB    REG_CNTR
     SUB     SPEED_CNTR,MC_BUFF
     CLRB    SLOW_CNTR
     CLRB    FAST_CNTR
     ANDB    POS_BYTE,#11111011B
     LDB     BELT_LOCKOUT_TMR,#50
     ORB     POS_BYTE,#00000001B
     ORB     BELT_STATUS,#01000001B             ;SET BELT HOLE FLAGS
     BR      EXIT_BELT_CHECK


NO_PULSE:
     ANDB    POS_BYTE,#11111101B                ;CLR POLL MODE BIT
     CLRB    PULSE_LENGTH
     LD      MC_BUFF,TEMP_MC_BUFF
EXIT_BELT_CHECK:
     RET
;*****************************************************************************
;
;
;*****************************************************************************

     END
```

Appendix B

```
$DEBUG
$PAGELENGTH(50)
INC_ERROR MODULE
;Copyright 1989, 1990, 1991 Xerox Corporation. All Rights Reserved.

$NOLIST
$INCLUDE (B1VALUES.INC)
$INCLUDE (B1APP96.INC)
$INCLUDE (SYM96.INC)
$LIST



      RSEG
;MC_TEMP:                DSW          1
;PR_TEMP:                DSW          1
ERR_LIMIT:               DSW          1
PHASE_ERROR:             DSW          1
SPEED_RATIO:             DSW          1
ERROR_REF:               DSW          1
;INC_PHASE_ERROR:        DSW          1
PREV_PHASE_ERROR:        DSW          1
OLD_REF_VALUE:           DSW          1
MC_TEMP_BUFF:            DSW          1
;INC_MC_POS:             DSW          1
;INC_PR_POS:             DSW          1
POS_BYTE:                DSB          1
REG_ERROR:               DSW          1


      PUBLIC  ERR_LIMIT
      PUBLIC  PHASE_ERROR,SPEED_RATIO,ERROR_REF,MC_TEMP_BUFF
      PUBLIC  POS_BYTE,PREV_PHASE_ERROR,OLD_REF_VALUE
      PUBLIC  REG_ERROR

      EXTRN   BELT_STATUS,PR_POS_CNTR,MC_POS_CNTR,MC_BUFF,STATUS_FLAG1
      EXTRN   MC_COUNT,NEW_REF_VALUE,DES_HZ,MC_REF,PORT0_SHADOW,BELT_TIMER
      EXTRN   MODE_REG,DEBUG_REG,ENC_INC_POS,SPEED_CNTR
      EXTRN   ERROR_TIME

;*****************************************************************************
;ROUTINE.INC_POS_ERROR:
;DESCRIPTION:
;       This module maintains the position relation between the registration
;       fingers and belt seam. This task is done in two parts.
;       The first part is referred to as the INITIAL POSITION ALIGNMENT (IPA).
;       The IPA is done during every cycle up. The IPA counts the number of
;       machine clocks pulses between the last belt hole and the first reg
;       finger sensed after that belt hole. The difference between machine clocks
;       counted and 401 is the PHASE_ERROR. Depending on whether the PHASE_ERROR is
;       negative or positive ,the motor is slowed down or sped up to drive the
```

```
;       error to zero.
;
;       After the IPA has been completed the software enters the rephase mode.
;       During the rephase mode the servo attempts to make sure the the PHASE_ERROR is within
;       +/- 30 mc of 401. If the error is outside the +/- 30 window, the servo drives
;       it back in. If the error is within the window but getting worse, the servo
;       drives the error back towards 401  If the error is inside the window and stays
;       the same or gets better during consecutive belt revsthe servo does nothing.
;
;*****************************************************************************


        CSEG

        PUBLIC  INC_POS_ERROR

INC_POS_ERROR:
        CMPB    MODE_REG,#CORRECTION
        JNE     CONTINUE_ERROR
        BR      PROCESS_ERROR
CONTINUE_ERROR:
        BBC     BELT_STATUS,REG_SWITCH,CHECK_PHASE          ;CHECK FOR REG SWITCH
        ANDB    BELT_STATUS,#11110111B                      ;CLR REG SW
        LD      AXW,#401
ERR_CALC:
        SUB     AXW,MC_COUNT                                ;GET POSITION ERROR
        LD      PHASE_ERROR,AXW                             ;STORE ERR
        ORB     POS_BYTE,#10000000B                         ;SET POS_DATA_RDY
        LD      ERROR_REF,DES_HZ                            ;STORE CURRENT SPEED
        BBC     BELT_STATUS,POS_ERR_SET,GET_INC_POSITION
CHECK_PHASE:
;       LDB     PORT0_SHADOW,PORT0
;       BBC     PORT0_SHADOW,6,NO_ADJUST                    ;SEE IF SPEED_ADJ ACTIVE
;       ORB     POS_BYTE,#00000100B                         ;SET SPEED ADJUST FLAG
        BBC     POS_BYTE,SPEED_ADJUST,NO_ADJUST
        ANDB    POS_BYTE,#11111011B                         ;CLR SPEED ADJ
        BBC     POS_BYTE,POS_DATA_RDY,NO_ADJUST             ;CHECK IF DATA AVAIL
        ANDB    POS_BYTE,#01111111B                         ;CLEAR POS DATA READY
        JBS     POS_BYTE,3,OUT_OF_RANGE                     ;DONT CORRECT IF CAL MODE
        LD      AXW,PHASE_ERROR                             ;RETRIEVE PHASE ERROR
        JBS     AXHB,7,NEGATIVE_ERROR
        CMP     AXW,#3                                      ;CHECK IF ERR WITHIN +3 WINDOW
        JLE     NO_ADJUST
        CMP     AXW,#30                                     ;CHECK IF ERR EXCEEDS LIMITS
        JGE     OUT_OF_RANGE
        LD      CXW,PREV_PHASE_ERROR
        JBS     CXHB,7,INCREMENT_SPEED                      ;CHECK FOR POLARITY CROSSOVER
        ADD     ERR_LIMIT,PREV_PHASE_ERROR,#3               ;check id err within +3 of last error
        CMP     AXW,ERR_LIMIT
        JLT     NO_ADJUST                                   ;don't adjust if err < prev_err + 3
INCREMENT_SPEED:
        ADD     AXW,NEW_REF_VALUE,#1
        BR      GET_READY
NEGATIVE_ERROR:
```

```
      CMP     AXW,#-3                                   ;CHECK IF ERR WITHIN -3
      JGE     NO_ADJUST
      CMP     AXW,#-30
      JLE     OUT_OF_RANGE
      LD      CXW,PREV_PHASE_ERROR                      ;GET PREVIOUS ERROR
      JBC     CXHB,7,DECREMENT_SPEED                    ;dec if err crossed 0
      ADD     ERR_LIMIT,PREV_PHASE_ERROR,#0FFFDH;
      CMP     AXW,ERR_LIMIT
      JGT     NO_ADJUST
DECREMENT_SPEED:
      ADD     AXW,NEW_REF_VALUE,#0FFFFH
GET_READY:
      LD      PREV_PHASE_ERROR,PHASE_ERROR
      CMP     NEW_REF_VALUE,ERROR_REF
      BR      CHECK_SPEED
NO_ADJUST:
      BR      EXIT_INC_POS

OUT_OF_RANGE:
      BR      CHECK_MC_COUNT

GET_INC_POSITION:
      ANDB    POS_BYTE,#01111111B                       ;CLEAR POS_DATA_RDY FLA
      BBC     BELT_STATUS,MC_REF_SET,EXIT_INC_POS
      LDB     MODE_REG,#CORRECTION
GET_RATIO:
      CLR     BXW
      LD      AXW,ERROR_REF                             ;GET PRESENT SPEED
      MULU    AXL,AXW,#1000                             ;SCALE SPEED
      DIVU    AXL,MC_REF                                ;GET PC/MC RATIO
      LD      SPEED_RATIO,AXW                           ;STORE RATIO
      LD      AXW,PHASE_ERROR
      JBC     AXHB,7,POSITIVE_ERROR
      NEG     AXW
POSITIVE_ERROR:
      CMP     AXW,#101
      JGE     ERR_200
      LD      REG_ERROR,AXW
      ADD     ERROR_TIME,BELT_TIMER,#1000
      BR      CHECK_POLARITY
ERR_200:
      CMP     AXW,#201
      JGE     ERR_300
      SHR     AXW,#1
      LD      REG_ERROR,AXW
      ADD     ERROR_TIME,BELT_TIMER,#2000
      BR      CHECK_POLARITY
ERR_300:
      CLR     BXW
      DIVU    AXL,#3
      LD      REG_ERROR,AXW
      ADD     ERROR_TIME,BELT_TIMER,#3000
CHECK_POLARITY:
      LD      AXW,PHASE_ERROR
```

```
      BBC     AXHB,7,ADD_POS_ERROR
      NEG     REG_ERROR
      BR      ADD_POS_ERROR
PROCESS_ERROR:
      CMP     ERROR_TIME,BELT_TIMER
      JNE     ADD_POS_ERROR
      BR      ERROR_OK
ADD_POS_ERROR:
      CLR     BXW                                  ;CALCULATE CORRECTION
      LD      AXW,REG_ERROR
      ADD     AXW,MC_REF
      MULU    AXL,AXW,ERROR_REF;SPEED = [(ERR + MCREF)/MC_REF]REF_SPEED
      DIVU    AXL,MC_REF
CHECK_SPEED:
      CMP     AXW,#MAX_FAST_SPEED
      JLT     CHECK_LOW_SPEED
      LD      AXW,#MAX_FAST_SPEED                  ;LIMIT HIGH SPEED
      BR      GET_NEW_SPEED
CHECK_LOW_SPEED:
      CMP     AXW,#MIN_SLOW_SPEED
      JGT     GET_NEW_SPEED
      LD      AXW,#MIN_SLOW_SPEED                  ;LIMIT LOW SPEED
GET_NEW_SPEED:
      LD      NEW_REF_VALUE,AXW
      BR      EXIT_INC_POS
ERROR_OK:
      LDB     MODE_REG,#RUN
      LD      NEW_REF_VALUE,ERROR_REF
      ORB     BELT_STATUS,#00010000B               ;set POS_ERR_SET FLAG
      CLR     PREV_PHASE_ERROR
EXIT_INC_POS:
      NOP
      RET

;*****************************************************************************
;
;
;*****************************************************************************
CHECK_MC_COUNT:
      JBS     POS_BYTE,3,CONTU_CHECK
      ORB     POS_BYTE,#00001000B                  ;SET calibration MODE
      BR      STORE_MC_BUFF
CONTU_CHECK:
      SUB     BXW,MC_BUFF,MC_TEMP_BUFF;CHECK FOR STABILITY
      JBS     BXHB,7,NEG_VARIATION
      CMP     BXW,#4
      JGE     STORE_MC_BUFF
      BR      LOAD_SPEED
NEG_VARIATION:
      CMP     BXW,#0FFFCH
      JLE     STORE_MC_BUFF
      BR      LOAD_SPEED
STORE_MC_BUFF:
      LD      MC_TEMP_BUFF,MC_BUFF
```

```
      ANDB    BELT_STATUS,#11111101B              ;CLEAR MC_REF_SET
      BR      EXIT_CHECK_COUNT
LOAD_SPEED:
      SUB     AXW,MC_BUFF,#NOMINAL_MCLKS ;CHECK MC/REV VARIATION
      CLR     BXW
      ADD     AXW,AXW,#NOMINAL_MCLKS
      MULU    AXL,DES_HZ,AXW
      LD      CXW,#NOMINAL_MCLKS
      DIVU    AXL,CXW
      LD      OLD_REF_VALUE,DES_HZ
      LD      NEW_REF_VALUE,AXW
      CLR     PREV_PHASE_ERROR
      ANDB    BELT_STATUS,#11101111B; CLEAR POS_ERR_SET
      ANDB    POS_BYTE,#11110111B                 ;CLEAR CALIBRATION FLAG
EXIT_CHECK_COUNT:
      BR      EXIT_INC_POS
      END
```

Appendix C

```
$DEBUG
$PAGELENGTH(50)
MOTOR_IO MODULE  STACKSIZE(06)
;Copyright (c) 1989, 1990, 1991 Xerox Corporation. All Rights Reserved.

$NOLIST
$INCLUDE (SYM96.INC)
$INCLUDE (B1APP96.INC)
$INCLUDE (B1VALUES.INC)
$LIST
 ENC_TIMER_LOAD   SET   (ENC_DELAY*250 + (TIMER_PERIOD/2))/TIMER_PERIOD

    ENC_TIMER_LOAD   SET   ENC_TIMER_LOAD*4

IF ENC_DELAY LE 100
 ENC_TIMER_LOAD   SET   (ENC_DELAY*500 + (TIMER_PERIOD/2))/TIMER_PERIOD

    ENC_TIMER_LOAD   SET   ENC_TIMER_LOAD*2
ENDIF

IF   ENC_DELAY LE 50
    ENC_TIMER_LOAD SET (ENC_DELAY*1000 + (TIMER_PERIOD/2))/TIMER_PERIOD
ENDIF
    RSEG

ENC_INTEGER:                DSB          1
ENC_RISING_TIME:            DSW          1
ENC_PERIOD:                 DSW          1
ENC_PREV_RISING_TIME:       DSW          1

REF_INTEGER:                DSB          1
REF_RISING_TIME:            DSW          1
REF_PERIOD:                 DSW          1
REF_PREV_RISING_TIME:       DSW          1

HSI_TIME_IMAGE:             DSW          1
INTERRUPT_TIME:             DSW          1
SAMPLE_COUNTS:              DSW          1

SPEED_CNTR:                 DSW          1
PREV_MC_BUFF:               DSW          1
SPEED_ADJ_CNTR:             DSW          1
```

```
IOS1_SAVE:                DSB          1
SCON_COPY:                DSB          1
HSI_STAT_IMAGE:           DSB          1
REG_CNTR:                 DSB          1
MODE_REG:                 DSB          1
BELT_LOCKOUT_TMR:         DSB          1

   PUBLIC  SAMPLE_COUNTS,PREV_MC_BUFF,SPEED_ADJ_CNTR
   PUBLIC  REG_CNTR,MODE_REG,SPEED_CNTR,BELT_LOCKOUT_TMR

   PUBLIC  ENC_PERIOD, REF_PERIOD, ENC_INTEGER

   EXTRN   ENC_POS_INT, ENC_POS_FRA
   EXTRN   REF_POS_INT, REF_POS_FRA, MOT_DIST_CNT

   EXTRN   MOTOR_COMMAND,DES_HZ,TEMP_MC_BUFF,APP_ERROR
   EXTRN   IOC0_SHADOW, PORT0_SHADOW, STATUS_FLAG1

   EXTRN   BELT_STATUS, PR_POS_CNTR,MC_POS_CNTR,NEW_SPEED
   EXTRN   TEMP_PR_CNT,ERROR_TIME,TEMP_REF
   EXTRN   MC_COUNT,MC_TIME,PREV_MC_TIME,MC_BUFF
   EXTRN   NUMBER_OF_MC,MC_PERIOD,MSEC_DELAY,NEW_REF_VALUE
   EXTRN      SLOW_CNTR,FAST_CNTR,BELT_TIMER,POS_BYTE


   CSEG   AT    2000H

   DCW    TIMERS, A_TO_D, HSI_CODE, HSO_CODE
   DCW    HSI_0_CODE, SOFT_TIMERS, SERIAL, EXTINT

   EXTRN  CALC_POS_ERROR

   CSEG   AT    2018H

   DCB    0FDH
;
   CSEG

TIMERS:
   PUSHF
   ORB    IOS1_SAVE, IOS1
   JBC    IOS1_SAVE, 5, TRY_TIMER2
;  CALL   TIMER_1_OV
TRY_TIMER2:
   JBC    IOS1_SAVE, 4, TIMERS_RET
;  CALL   TIMER_2_OV
TIMERS_RET:
   ANDB   IOS1_SAVE, #11001111B
   POPF
   RET

A_TO_D:
   PUSHF
;ENTER A TO D CODE HERE
   POPF
   RET

HSO_CODE:
   PUSHF
```

```
    SUB    ENC_POS_FRA, INTERRUPT_TIME, ENC_RISING_TIME
    SUB    ENC_PERIOD, ENC_RISING_TIME, ENC_PREV_RISING_TIME
    LDB    ENC_POS_INT, ENC_INTEGER

    SUB    REF_POS_FRA, INTERRUPT_TIME, REF_RISING_TIME
    SUB    REF_PERIOD, REF_RISING_TIME, REF_PREV_RISING_TIME
    LDB    REF_POS_INT, REF_INTEGER

    ORB    STATUS_FLAG1, #SET_SAMPLE_BIT
    ADD    INTERRUPT_TIME, SAMPLE_COUNTS
    LDB    HSO_COMMAND, #00110011B          ;HSO 3 AS TIMER
    LD     HSO_TIME, INTERRUPT_TIME

;ENTER HSO CODE HERE
    POPF
    RET

HSI_0_CODE:
    PUSHF
;ENTER HSI 0 CODE HERE
    POPF
    RET

SERIAL:
    PUSHF
    ORB    SCON_COPY, SP_CON
    BBC    SCON_COPY, 6, CHECK_TRANS
;   CALL   RECEIVE
CHECK_TRANS:
    BBC    SCON_COPY, 5, SERIAL_RET
;   CALL   TRANSMIT
SERIAL_RET:
    CLRB   SCON_COPY
    POPF
    RET
;

EXTINT:
    PUSHF

EXTINT_DN:
    POPF
    RET

SOFT_TIMERS:
    PUSHF
    ORB    IOS1_SAVE, IOS1
    JBC    IOS1_SAVE, 0, NOT_TIMER_0   ;CHECK TIMER 0
    CALL   SOFT_TIMER_0
NOT_TIMER_0:
    JBC    IOS1_SAVE, 1, NOT_TIMER_1   ;CHECK TIMER 0
;   CALL   SOFT_TIMER_1
NOT_TIMER_1:
    JBC    IOS1_SAVE, 2, NOT_TIMER_2   ;CHECK TIMER 0

;   CALL   SOFT_TIMER_2
NOT_TIMER_2:
    JBC    IOS1_SAVE, 3, SOFT_TIMER_RET ;CHECK TIMER 0
;   CALL   SOFT_TIMER_3
SOFT_TIMER_RET:
    ANDB   IOS1_SAVE, #11110000B
    POPF                    ;OTHER INTERRUPTS
    RET
```

```
SOFT_TIMER_0:
    BBS BELT_STATUS,INIT_FLAG,INCREMENT_TIMER
    CMP MSEC_DELAY,#POWERUP_DELAY        ;CHK FOR CYCLE UP D
    JNE PROCESS_INTR
    CLR     NUMBER_OF_MC
    LD  MODE_REG,#INIT
    ORB BELT_STATUS,#10000000B          ;SET INIT_FLAG
    BR      PROCESS_INTR
INCREMENT_TIMER:
      INC   BELT_TIMER
PROCESS_INTR:
    SUB ENC_POS_FRA, INTERRUPT_TIME, ENC_RISING_TIME
    SUB ENC_PERIOD, ENC_RISING_TIME, ENC_PREV_RISING_TIME
    LDB ENC_POS_INT, ENC_INTEGER

    SUB REF_POS_FRA, INTERRUPT_TIME, REF_RISING_TIME
    SUB REF_PERIOD, REF_RISING_TIME, REF_PREV_RISING_TIME
    LDB REF_POS_INT, REF_INTEGER

    ORB STATUS_FLAG1, #SET_SAMPLE_BIT
    ADD INTERRUPT_TIME, SAMPLE_COUNTS
    LDB HSO_COMMAND, #00011000B         ;SOFTWARE TIMER 0
    LD  HSO_TIME, INTERRUPT_TIME

EXIT_TR0:
      BBC     HSI_STATUS,MOTOR_ON,NO_TIMER
      INC     MSEC_DELAY
      CMPB    BELT_LOCKOUT_TMR,#0
      JNE     DEC_TIMER
      ANDB    POS_BYTE,#11111110B
      BR      NO_TIMER
DEC_TIMER:
      DECB    BELT_LOCKOUT_TMR
NO_TIMER:
    RET

HSI_CODE:
    PUSHF
MORE_HSI:
    ANDB   IOS1_SAVE, #00111111B
    ORB    IOS1_SAVE, IOS1
    JBC    IOS1_SAVE, 7, HSI_DONE
    LDB    HSI_STAT_IMAGE, HSI_STATUS
    LD     HSI_TIME_IMAGE, HSI_TIME
    JBC    HSI_STAT_IMAGE, 0, NOT_ENC_0

    CALL   HSI_0_INT
NOT_ENC_0:
    JBC    HSI_STAT_IMAGE, 2, NOT_ENC_1
    CALL   HSI_1_INT
NOT_ENC_1:
    JBC    HSI_STAT_IMAGE, 4, NOT_ENC_2
;   CALL   HSI_2_INT
NOT_ENC_2:
    JBC    HSI_STAT_IMAGE, 6, MORE_HSI
    CALL   HSI_3_INT
    BR     MORE_HSI
HSI_DONE:
    POPF
    RET
```

```
HSI_0_INT:
      BBC      HSI_STATUS,MOTOR_ON,CONT_HSI_0
    INC   PR_POS_CNTR              ;KEEP TRACK OF PR C
CONT_HSI_0:
    LD    ENC_PREV_RISING_TIME, ENC_RISING_TIME
    LD    ENC_RISING_TIME,HSI_TIME_IMAGE
    INCB  ENC_INTEGER
    DEC   MOT_DIST_CNT
    BR        HSI_0_EXIT
HSI_0_EXIT:
    RET

HSI_1_INT:
      BBC      HSI_STATUS,MOTOR_ON, HSI_1_EXIT
    INC  MC_POS_CNTR       ;KEEP TRACK OF MACH
    INC      SPEED_CNTR                          ;count # of mc/belt rev
      BBC      BELT_STATUS,INIT_FLAG,HSI_1_EXIT
      BBS      BELT_STATUS,MC_REF_SET,CHECK_SPEED_ADJ_CNTR
      CMP      NUMBER_OF_MC,#0
      BE       STORE_TIME
      CMP      NUMBER_OF_MC,#79
      BLT      RAISE_COUNT
      INC      NUMBER_OF_MC
      SUB      MC_TIME,HSI_TIME_IMAGE,PREV_MC_TIME
      BR       HSI_1_EXIT
STORE_TIME:
      LD       PREV_MC_TIME,HSI_TIME_IMAGE ;store time of 1st mc

RAISE_COUNT:
      INC      NUMBER_OF_MC
      BR       HSI_1_EXIT
CHECK_SPEED_ADJ_CNTR:
      BBC      POS_BYTE,SPADJ_CNTR_ENB,HSI_1_EXIT
      DEC      SPEED_ADJ_CNTR
      JNE      HSI_1_EXIT
      ANDB     POS_BYTE,#11011111B                ;CLR SPDADJ_CNTR_ENB
      ORB      POS_BYTE,#00000100B                ;SET SPEED ADJ FLAG
HSI_1_EXIT:
    RET
HSI_3_INT:
        BBC      BELT_STATUS,BELT_HOLE,CONTU_HSI3;CHECK BELT HOLE
        ANDB     BELT_STATUS,#10111111B             ;CLEAR BELT HOLE FLAG
        LD       MC_COUNT,SPEED_CNTR
        ORB      BELT_STATUS,#00001000B             ;SET REG_SWITCH
        CMPB     MODE_REG,#RUN
;       JNE      EXIT_HSI3
        JNE      CONTU_HSI3
        ORB      POS_BYTE,#00100000B                ;SET SPDADJ_CNTR_ENB
        LD       SPEED_ADJ_CNTR,#615
CONTU_HSI3:
        INCB   REG_CNTR
EXIT_HSI3:
    RET


    PUBLIC  INTERRUPT_INIT

INTERRUPT_INIT:
    CLRB  IOS1_SAVE
    CLRB  SCON_COPY
    LD    ENC_RISING_TIME, TIMER1
    SUB   ENC_PREV_RISING_TIME, ENC_RISING_TIME, SAMPLE_COUNTS
    LD    REF_RISING_TIME, TIMER1
```

```
    SUB    REF_PREV_RISING_TIME, REF_RISING_TIME, SAMPLE_COUNTS
    LD     MC_TIME,TIMER1
    ADD    INTERRUPT_TIME, TIMER1, SAMPLE_COUNTS
    CLRB   IOC0
    CLRB   IOC0_SHADOW
    CLRB   IOC1
    LDB    IOC1, #00100001B                    ;set pwm & enb txd
    CLRB   INT_PENDING
    CLRB   INT_MASK
CHECK_HSI_CAM:
    ANDB   IOS1_SAVE, #00111111B
    ORB    IOS1_SAVE, IOS1
    JBC    IOS1_SAVE, 7, HSI_CAM_CLR
    LDB    AXLB, HSI_STATUS
    LD     AXW, HSI_TIME
    BR     CHECK_HSI_CAM
HSI_CAM_CLR:
    CLRB   IOS1_SAVE
;;DRIVE ROLL ENCODER CONFIG
    LDB    HSI_MODE, #57H          ;SET RISING EDGE ON HSI 0,1,2
                                   ;RISING EDGE ON HSI 3
;STRIPPER ROLL ENCODER CONFIG
;       LDB     HSI_MODE,#55H      ; USED FOR STRIPPER ROLL ENC
; IF TRACKING EQ 1
    LDB    IOC0_SHADOW, #01000101B ;ENABLE HSI 0, HSI 1
                                   ;and HSI_3

; ELSE
;   LDB    IOC0_SHADOW, #00000001B ;ENABLE HSI 0

; ENDIF
    ORB    INT_MASK, #00000100B    ;ALLOW HSI,EXT INTE


;   BBS    HSI_STATUS, DIAG, SAMPLE_TIMER_HSO
      BBS      PORT0_SHADOW,DIAG,SAMPLE_TIMER_HSO

    LDB    HSO_COMMAND, #00011000B ;SET SAMPLE TIME IN

    LD     HSO_TIME, INTERRUPT_TIME
    ORB    INT_MASK, #00100000B    ;ALLOW SOFTWARE TIM

    EI                     ;GLOBAL INTERRUPTS
    RET

SAMPLE_TIMER_HSO:
    LDB    HSO_COMMAND, #00110011B ;SET SAMPLE TIME HS
    LD     HSO_TIME, INTERRUPT_TIME
    ORB    INT_MASK, #00001000B    ;ALLOW HSO INT
    EI                     ;GLOBAL ALLOW INTER

    RET


    PUBLIC  CALC_SAMPLE_COUNTS

CALC_SAMPLE_COUNTS:
    LD     AXW, #SAMPLE_TIME
    MULU   AXL, #1000
    LD     CXW, #TIMER_PERIOD
    SHR    CXW, #01
    ADD    AXW, CXW
    ADDC   BXW, #00
```

```
DIVU   AXL, #TIMER_PERIOD
LD     SAMPLE_COUNTS, AXW
RET
END
```

Appendix D

```
$DEBUG
$PAGELENGTH(50)

GENMOT      MODULE
;Copyright 1989, 1990, 1991 Xerox Corporation. All Rights Reserved.

$NOLIST
$INCLUDE (B1APP96.INC)
$INCLUDE (SYM96.INC)
$INCLUDE (B1VALUES.INC)
$LIST

     RSEG

MOT_COUNTER:            DSB             1
MOTOR_FAULTS:           DSB             1
TOTAL_FAULTS:           DSW             1

     PUBLIC  MOTOR_FAULTS, TOTAL_FAULTS

     EXTRN   ENC_POS_INT, ENC_INTEGER, ENC_PREV_POS_INT, ENC_INC_POS
     EXTRN   PWM_NOMINAL,APP_ERROR,BELT_STATUS
     EXTRN   STATES, STATE_LEN
     EXTRN   IOC0_SHADOW
     EXTRN   REF_INC_POS
     EXTRN   STATE_PTR

     EXTRN   MOT_DIST_CNT,SLOW_CNTR,FAST_CNTR
     EXTRN   DES_HZ
     EXTRN   ACCEL_DECEL_RATE
     EXTRN   STATUS_FLAG0, STATUS_FLAG1, COMMAND_FLAG0


     CSEG

     PUBLIC  MOT_INIT, MOT_CL, MOT_OL, STANDBY, MOT_SEQUENCER
     EXTRN   START_SHUTDOWN


MOT_SEQUENCER:
     BR      [STATE_PTR]

MOT_INIT:
     CLR     PWM_NOMINAL
     LDB     PWM_CONTROL, #80H
     ANDB    IOC0_SHADOW, #DISABLE_ENC          ;disable the encoder
     DI
     LDB     HSO_COMMAND, #DISABLE_AMP          ;disable the amplifier
     ADD     HSO_TIME, TIMER1, #04
```

```
        EI
        LD      AXW, #(STATE_LEN)
        SHL     AXW, #01
INIT_CLR_STATES:
        SUB     AXW, #02
        ST      ZERO, STATES[AXW]
        CMP     AXW, #ZERO
        BNE     INIT_CLR_STATES
        LD      REF_INC_POS, #MIN_CL_CUTIN
        ST      ZERO, DES_HZ
        CLRB    ENC_INTEGER
        CLRB    ENC_PREV_POS_INT
        LDB     MOT_COUNTER, #MAX_OL_ITER
        LDBZE   AXW, MOTOR_FAULTS
        ADD     AXW, TOTAL_FAULTS
        ST      AXW, TOTAL_FAULTS
        STB     ZERO, MOTOR_FAULTS
        ANDB    STATUS_FLAG0, #11110000B        ;clear the invert PWM bit, closed loop bits
        ANDB    AXLB, COMMAND_FLAG0, #00000001B ;isolate the direction bit
        ORB     STATUS_FLAG0, AXLB                      ;load the dir bit into the status flag
        ORB     STATUS_FLAG0, #00001000B        ;assume analog inactive
        ANDB    STATUS_FLAG1, #11110001B
        LD      STATE_PTR, #STANDBY
        BR      RUN_NEXT_PROCESS

STANDBY:
        NOP
        LD      AXW, DES_HZ
        CMP     AXW, #MIN_CL_CUTIN
        BLT     RUN_NEXT_PROCESS
        LD      STATE_PTR, #MOT_OL
        BR      RUN_NEXT_PROCESS
;
MOT_OL:
        BBC     HSI_STATUS, MOTOR_ON, MOT_INIT
        ORB     IOC0_SHADOW, #ENABLE_ENC        ;enable the encoder
        DI
        LDB     HSO_COMMAND, #ENABLE_AMP        ;enable the amplifier
        ADD     HSO_TIME, TIMER1, #04
        EI
        LDB     AXLB, STATUS_FLAG0
        XORB    AXLB, COMMAND_FLAG0
        BBC     AXLB, DIR, CHECK_3_COUNTS       ;check the reversal bit
        XORB    STATUS_FLAG0, #CHANGE_PWM_POL   ;change sense of PWM
        BR      PWM_OUT_OL
CHECK_3_COUNTS:
        CMPB    ENC_POS_INT, #03
        BLT     PWM_OUT_OL
        CMP     ENC_INC_POS, #MIN_CL_CUTIN
        BLT     PWM_OUT_OL
        LDB     MOT_COUNTER, #GAIN_COMP_ITER + 1
        LD      STATE_PTR, #MOT_CL                      ;next time, do closed loop
        ORB     STATUS_FLAG1, #CL_CONTROL_ACTIVE ;about to start closed loop with gain
PWM_OUT_OL:
```

```
        CLR     PWM_NOMINAL
        LD      AXW, DES_HZ
        CLR     BXW
        DIVU    AXL, #HZ_PER_BIT
        ADDB    PWM_NOMINAL + 1, AXLB, #PWM_OFFSET
        ADDB    PWM_NOMINAL + 1, #PWM_FEEDFOWARD
        BNV     OL_PWM_OK
        LDB     PWM_NOMINAL + 1, #125
OL_PWM_OK:
        LD      CXW, PWM_NOMINAL
        BBC     STATUS_FLAG0, PWM_POLARITY, NO_INVERT_OUTPUT
        NEG     CXW
NO_INVERT_OUTPUT:
        ADD     CXW, #8000H
        LDB     PWM_CONTROL, CXHB
;check number of iterations
        DECB    MOT_COUNTER
        BNE     RUN_NEXT_PROCESS
        INCB    MOT_COUNTER
;       BR      STATE_ERROR
        BR      SPEED_TOO_SLOW

;
MOT_CL:
        BBC     COMMAND_FLAG0, DIST_CNT_FLAG, CONTINUE_CL
        CMP     MOT_DIST_CNT, #02
        BGT     CONTINUE_CL
        ORB     STATUS_FLAG1, #DIST_CNT_LE_0
        ADD     MOT_DIST_CNT, #7F00H
        ST      ZERO, DES_HZ
CONTINUE_CL:
        LD      AXW, DES_HZ
        CLR     BXW
        DIVU    AXL, #HZ_PER_BIT
        CLR     PWM_NOMINAL
        ADDB    PWM_NOMINAL + 1, AXLB, #PWM_OFFSET
        CMP     REF_INC_POS, DES_HZ
        BE      MOT_CL_CONSTANT
        LDB     MOT_COUNTER, #GAIN_COMP_ITER    ;go back to pure gain control
        ANDB    STATUS_FLAG1, #CL_NOT_SS        ;signal not locked into final speed
        CMP     REF_INC_POS, DES_HZ
        BGT     DECEL_VELOCITY
ACCEL_VELOCITY:
        LD      AXW, ACCEL_DECEL_RATE
        BBS     COMMAND_FLAG0, LINEAR_RAMP, RAMP_UP
        SUB     AXW, DES_HZ, REF_INC_POS        ;exponential accel
        MULU    AXL, ACCEL_DECEL_RATE
        DIVU    AXL, #1000
        INC     AXW                             ;round up the result
RAMP_UP:
        ADD     REF_INC_POS, AXW
        ADDB    PWM_NOMINAL + 1, #PWM_FEEDFOWARD
        BNV     NOM_PWM_ACC_OK
        LDB     PWM_NOMINAL + 1, #125
NOM_PWM_ACC_OK:
        CMP     REF_INC_POS, DES_HZ
        BLT     RUN_NEXT_PROCESS
        LD      REF_INC_POS, DES_HZ
        BR      RUN_NEXT_PROCESS
```

```
DECEL_VELOCITY:
      LD      AXW, ACCEL_DECEL_RATE
      BBS     COMMAND_FLAG0, LINEAR_RAMP, RAMP_DOWN
      SUB     AXW, REF_INC_POS, DES_HZ            ;exponential decel
      MULU    AXL, ACCEL_DECEL_RATE
      DIVU    AXL, #1000
      INC     AXW
RAMP_DOWN:
      SUB     REF_INC_POS, AXW
      SUBB    PWM_NOMINAL + 1, #PWM_FEEDFOWARD
      CMPB    PWM_NOMINAL + 1, #-PWM_OFFSET/2
      BGT     OFFSET_NON_NEG
      LDB     PWM_NOMINAL + 1, #-PWM_OFFSET/2
OFFSET_NON_NEG:
      CMP     DES_HZ, #MIN_CL_CUTIN
      BGE     NOT_DES_SLOW
      CMP     REF_INC_POS, #MIN_CL_CUTIN
      BLT     NEXT_STATE_INIT
      BR      RUN_NEXT_PROCESS
NOT_DES_SLOW:
      CMP     REF_INC_POS, DES_HZ
      BGT     RUN_NEXT_PROCESS
      LD      REF_INC_POS, DES_HZ
      BR      RUN_NEXT_PROCESS

NEXT_STATE_INIT:
      LD      REF_INC_POS, #ZERO
      LD      STATE_PTR, #MOT_INIT
      BR      RUN_NEXT_PROCESS
;

MOT_CL_CONSTANT:
      BBS     STATUS_FLAG1, CL_STEADY_STATE, INTO_LOCKED_RANGE      ;start error checking after
settling
      DJNZ    MOT_COUNTER, RUN_NEXT_PROCESS
      LDB     MOT_COUNTER, #GAIN_COMP_ITER
      BBS     STATUS_FLAG1, CL_FULL_COMP, ENTER_SS_COND
      ORB     STATUS_FLAG1, #CL_FULL_ACTIVE
      BR      RUN_NEXT_PROCESS
ENTER_SS_COND:
      BBC     STATUS_FLAG0, NO_EXT_MODULATE, RUN_NEXT_PROCESS
      ORB     STATUS_FLAG1, #CL_SS_ACTIVE
INTO_LOCKED_RANGE:                                              ;from gain iterations
      CMP     ENC_INC_POS, #MIN_CL_CUTIN/2
      BLT     SPEED_TOO_SLOW
      SUB     AXW, REF_INC_POS, ENC_INC_POS
      CMP     AXW, #ENCODER_MULT
      BGT     SPEED_TOO_SLOW
      CMP     AXW, #-ENCODER_MULT

      BLT     SPEED_TOO_FAST
CONSTANT_RET:
      BR      RUN_NEXT_PROCESS
;

STATE_ERROR:
      LDB     AXLB, MOTOR_FAULTS
      INCB    AXLB
      STB     AXLB, MOTOR_FAULTS
      BBS     COMMAND_FLAG0, NO_ERROR_CHECK, RUN_NEXT_PROCESS
      BBC     STATUS_FLAG0, NO_EXT_MODULATE, RUN_NEXT_PROCESS
      CMPB    AXLB, #MAX_ALLOWED_FAULTS
      BGT     SHUTDOWN
```

```
      BR      RUN_NEXT_PROCESS
SHUTDOWN:
      ORB     STATUS_FLAG0, #ERROR_STATE
      BR      START_SHUTDOWN
;     BR      RUN_NEXT_PROCESS
;
SPEED_TOO_SLOW:
      BBC     BELT_STATUS,INIT_flag,RUN_NEXT_PROCESS
      INCB    SLOW_CNTR
      JNV     RUN_NEXT_PROCESS
      CMPB    APP_ERROR,#0
      JNE     RUN_NEXT_PROCESS
      ORB     APP_ERROR,#00000001B                ;SET FLAG
      BR      RUN_NEXT_PROCESS
SPEED_TOO_FAST:
      BBC     BELT_STATUS,INIT_flag,RUN_NEXT_PROCESS
      INCB    FAST_CNTR
      JNV     RUN_NEXT_PROCESS
      CMPB    APP_ERROR,#0
      JNE     RUN_NEXT_PROCESS
      ORB     APP_ERROR,#00000010B
RUN_NEXT_PROCESS:
      RET
;
;
      END
```

We claim:

1. A method of controlling photoreceptor speed in an electrophotographic printing machine to space the photoreceptor seam from electrostatic latent images recorded thereon, comprising the steps of:

measuring a phase relationship between the photoreceptor seam and one edge of a sheet adapted to have a developed latent image transferred thereto to determine a measured phase relationship;

comparing the measured phase relationship to a desired phase relationship to calculate a phase error; and determining a new photoreceptor speed as a function of the phase error.

2. The method of claim 1, further including the steps of:

altering the photoreceptor speed, to achieve the new photoreceptor speed, during periods when no exposure of latent images is occurring;

moving the photoreceptor at a constant speed during exposure of the latent electrostatic images; and repeating the preceding steps for each revolution of the photoreceptor.

3. The method of claim 1, wherein the step of measuring the phase relationship between the photoreceptor seam and one edge of the sheet further comprises the steps of:

detecting the location of the photoreceptor seam, and concurrently setting a counter to zero;

subsequently incrementing the counter using a regular periodic signal;

detecting the presence of the sheet at a predefined location; and immediately reading the value of the counter to establish a measurement indicative of the phase relationship.

4. The method of claim 2, wherein the step of determining a new photoreceptor speed as a function of the phase error further comprises the steps of:

retrieving, from a memory, a previous phase error value representative of the phase error measured in the preceding photoreceptor cycle;

determining the polarity of the phase error and determining if it is within acceptable predefined limits;

comparing the phase error value to the previous phase error value to determine if the phase error value is substantially unchanged, and if so, making no adjustment to the new photoreceptor speed; otherwise increasing the speed if the phase error is positive and greater than the previous phase error, or decreasing the speed if the phase error is negative and and less than the previous phase error.

5. The method of claim 4, further including the steps of:

determining if the phase error value exceeds a predefined limit, and if so, recognizing that a gross phase error is indicated; and placing the electrophotographic printing machine in an inoperative mode, whereby the system corrects the gross phase error.

6. The method of claim 4 wherein the step of comparing the phase error value to the previous phase error further includes the steps of:

determining a differential phase error as the difference between the phase error and the previous phase error;

comparing the magnitude of the differential phase error to a predetermined error threshold, whereby no adjustment is made to the new photoreceptor speed only if the magnitude is less than the threshold.

7. An apparatus for controlling the photoreceptor velocity in an electrophotographic printing machine to space the photoreceptor seam from electrostatic latent images recorded thereon, comprising:

phase measurement means for determining a measured phase relationship between the photoreceptor seam and one edge of a sheet adapted to have a developed latent image transferred thereto;

phase error calculating means for comparing the measured phase relationship to a desired phase relationship; and control means for determining an adjustment photoreceptor velocity as a function of the phase error.

8. The apparatus of claim 7, further comprising:

photoreceptor drive means for driving the photoreceptor at a constant velocity during exposure of the electrostatic latent images thereon; and means for accelerating or decelerating the photoreceptor to the adjustment photoreceptor velocity at times when no image exposure is occurring.

9. The apparatus of claim 8, wherein said phase measurement means further comprises:

clock means for producing a regular periodic signal suitable for measuring elapsed time;

a counter, sensitive to the signal generated by said clock means;

seam sensing means for detecting the location of the photoreceptor seam during rotation of the photoreceptor, said sensing means producing a signal suitable for resetting the counter to zero;

copy sheet edge sensing means for detecting the advancement of a copy sheet towards a transfer station where the copy sheet will be registered in synchronization with the latent image developed on the photoreceptor; and means responsive to said copy sheet sensing means for immediately reading the value of the counter, wherein the value is representative of the phase relationship between the photoreceptor seam and the developed latent image, the position of the latent image being in relation to the lead edge of the advancing copy sheet.

10. The apparatus of claim 9, wherein said seam sensing means further comprises:

an aperture accurately placed in proximity to one edge of the photoreceptor at a fixed distance from the photoreceptor seam;

optoelectronic sensor for detecting the location of the aperture during rotation of the photoreceptor, said sensor producing an active signal suitable for causing a reset of the counter;

11. The electrophotographic printing machine of claim 9, wherein said clock means further comprises:

an encoder, operatively connected to an independent drive associated with the registration means.

* * * * *